US011486150B2

(12) United States Patent
Stahl et al.

(10) Patent No.: US 11,486,150 B2
(45) Date of Patent: Nov. 1, 2022

(54) FINISHING ACCESSORY WITH BACKING STRIP

(71) Applicant: Clarkwestern Dietrich Building Systems LLC, West Chester, OH (US)

(72) Inventors: Gregg A. Stahl, Lebanon, OH (US); Adam J. Shoemaker, West Chester, OH (US)

(73) Assignee: Clarkwestern Dietrich Building Systems LLC, West Chester, OH (US)

( * ) Notice: Subject to any disclaimer, the term of this patent is extended or adjusted under 35 U.S.C. 154(b) by 0 days.

(21) Appl. No.: 15/848,068

(22) Filed: Dec. 20, 2017

(65) Prior Publication Data

US 2018/0171646 A1 Jun. 21, 2018

Related U.S. Application Data

(60) Provisional application No. 62/509,400, filed on May 22, 2017, provisional application No. 62/436,937, filed on Dec. 20, 2016.

(51) Int. Cl.
*E04F 19/06* (2006.01)
*E04B 1/94* (2006.01)
(Continued)

(52) U.S. Cl.
CPC ..... *E04F 21/0053* (2013.01); *E04F 13/068* (2013.01); *E04F 19/061* (2013.01); *E04F 21/0038* (2013.01); *E04F 21/02* (2013.01)

(58) Field of Classification Search
CPC ..... E04F 13/068; E04F 19/061; E04F 21/02; E04F 21/0038; E04F 21/0053;
(Continued)

(56) References Cited

U.S. PATENT DOCUMENTS

D47,309 S 5/1915 Terrell
1,960,137 A 5/1934 Brown
(Continued)

FOREIGN PATENT DOCUMENTS

CA 2082303 A1 5/1993
CA 2192420 A1 6/1998
(Continued)

OTHER PUBLICATIONS

Canadian Office Action, Application for Registration of an Industrial Design Examiner's Report dated Sep. 20, 2018 for Application No. CA 178,867 S, 4 pgs.
(Continued)

*Primary Examiner* — Brian E Glessner
*Assistant Examiner* — James J Buckle, Jr.
(74) *Attorney, Agent, or Firm* — Frost Brown Todd LLC

(57) ABSTRACT

A framing accessory includes a bead and a backing strip. The bead may comprise a first leg, a second leg, and a lip. The second leg may comprise a plurality of openings. The strip may be attached to the upper surface of the first leg. In some embodiments, the strip may comprise a single layer of material, while in other embodiments, the strip may comprise two or more layers of material. The strip may comprise material having fire resistant, intumescent, and/or sound insulating properties. The finishing accessory may be configured to be installed in a gap at a head of wall joint by positioning the first leg and strip along the top edge of a wallboard panel and the second leg extending vertically downward along the outer surface of the wallboard panel.

26 Claims, 26 Drawing Sheets

(51) Int. Cl.
*E04F 21/00* (2006.01)
*E04F 13/06* (2006.01)
*E04F 21/02* (2006.01)

(58) Field of Classification Search
CPC ..... E04F 13/06; E04F 2013/063; E04F 19/02; E04F 19/0436; E04F 19/0495; E04F 19/022; E04F 19/04; E04F 2019/0413; E04B 2/7457; E04B 2/825; E04B 2/7411; E04B 2/723; E04B 2/7409; E04B 1/94; E04B 1/948; E04C 2003/0473
USPC ..... 52/716.1
See application file for complete search history.

(56) References Cited

U.S. PATENT DOCUMENTS 2,023,814 A 12/1935 Lindsey
2,105,771 A 1/1938 Holdsworth
RE24,658 E 6/1959 Hollister
3,019,866 A * 2/1962 Grabowski ..... A47B 96/1408 403/4
3,041,682 A 7/1962 Alderfer et al.
3,309,826 A 3/1967 Zinn
3,324,615 A 6/1967 Zinn
3,423,893 A 1/1969 Hyatt
3,426,493 A 2/1969 Aspaas
3,460,302 A 8/1969 Cooper
3,512,318 A 5/1970 Turner
3,513,114 A 5/1970 Hahn et al.
3,543,460 A 12/1970 Stastny
3,606,714 A 9/1971 Arnett
3,667,174 A 6/1972 Arnett
3,712,015 A 1/1973 Nelson
3,754,367 A 8/1973 O'Konski et al.
3,782,680 A 1/1974 Hopkins
3,786,604 A 1/1974 Kramer
3,788,021 A 1/1974 Husler
3,837,126 A 9/1974 Voiturier et al.
3,908,328 A 9/1975 Nelsson
3,934,066 A 1/1976 Murch
3,940,899 A 3/1976 Balinski
3,950,912 A 4/1976 Lundberg et al.
3,997,505 A 12/1976 Albright
4,038,791 A 8/1977 Atkinson
4,084,348 A 4/1978 Hast
4,130,972 A 12/1978 Varlonga
4,189,619 A 2/1980 Pedlow
4,203,264 A 5/1980 Kiefer et al.
4,361,994 A 12/1982 Carver
4,376,361 A 3/1983 Michael
4,434,592 A 3/1984 Reneault et al.
4,443,991 A 4/1984 Mieyal
4,575,979 A 3/1986 Mariani
4,660,338 A 4/1987 Wagner
4,805,364 A 2/1989 Smolik
4,825,612 A 5/1989 Tupman
4,854,096 A 8/1989 Smolik
4,866,896 A 9/1989 Shreiner et al.
4,952,615 A 8/1990 Welna
4,993,203 A 2/1991 Tanaka
5,073,430 A 12/1991 Aidan
5,127,203 A 7/1992 Paquette
5,127,760 A 7/1992 Brady
5,160,784 A 11/1992 Shmidt et al.
5,245,811 A 9/1993 Knorr
5,296,534 A 3/1994 Senuma et al.
5,305,566 A 4/1994 Larkowski
5,313,752 A 5/1994 Hatzinikolas
5,412,919 A 5/1995 Pellock et al.
5,413,828 A 5/1995 De Keyser
5,423,154 A 6/1995 Maylon et al.
5,430,091 A 7/1995 Mahabir
5,452,551 A 9/1995 Charland et al.
5,471,805 A 12/1995 Becker
5,552,185 A 9/1996 De Keyser
5,671,967 A 9/1997 Gurganus et al.
5,689,922 A 11/1997 Daudet
5,694,731 A 12/1997 Tonsmann et al.
5,699,638 A 12/1997 Maylon
5,729,939 A 3/1998 Di Benedetto
5,755,066 A 5/1998 Becker
5,765,332 A 6/1998 Landin et al.
5,836,135 A * 11/1998 Hagan ..... E04B 1/762 52/836
5,887,395 A 3/1999 Navarro et al.
5,906,080 A 5/1999 diGirolamo et al.
5,913,788 A 6/1999 Herren
5,921,041 A 7/1999 Egri, II
5,946,870 A 9/1999 Bifano et al.
5,950,385 A 9/1999 Herren
5,953,872 A 9/1999 MacMillian
5,968,615 A 10/1999 Schlappa
5,970,671 A * 10/1999 Bifano ..... E04B 1/765 428/603
5,979,129 A 11/1999 Azar
6,058,668 A 5/2000 Herren
6,070,374 A 6/2000 Bifano et al.
6,110,559 A 8/2000 De Keyser
6,125,608 A 10/2000 Charlson
6,131,352 A 10/2000 Barnes et al.
6,141,923 A 11/2000 Habicht et al.
6,176,053 B1 1/2001 St Germain
6,192,646 B1 2/2001 Grewe et al.
6,207,085 B1 3/2001 Ackerman
6,216,404 B1 4/2001 Vellrath
6,253,516 B1 7/2001 D'Andrea et al.
6,293,064 B1 * 9/2001 Larson ..... E04B 1/762 52/209
6,295,776 B1 * 10/2001 Kunz ..... E04F 13/06 156/153
6,298,609 B1 * 10/2001 Bifano ..... E04B 1/765 52/101
6,324,797 B1 12/2001 Fago et al.
6,327,826 B1 12/2001 Mann
6,374,558 B1 4/2002 Surowiecki
6,401,427 B1 6/2002 Snyder
6,405,502 B1 6/2002 Cornwall
6,470,638 B1 * 10/2002 Larson ..... E04B 1/765 52/254
6,499,262 B1 12/2002 Pinchot et al.
D471,991 S * 3/2003 Maylon ..... D25/119
6,581,353 B2 6/2003 Augustine
6,612,087 B2 9/2003 diGirolamo
6,698,144 B1 3/2004 Larson
6,698,155 B2 3/2004 Menendez
6,706,793 B2 3/2004 Abu-Isa et al.
6,730,381 B2 5/2004 Horacek
6,745,703 B2 6/2004 Torrey et al.
6,747,074 B1 6/2004 Buckingham et al.
6,748,705 B2 6/2004 Orszulak et al.
6,783,345 B2 8/2004 Morgan et al.
6,809,129 B2 10/2004 Abu-Isa
6,848,227 B2 2/2005 Whitty
6,854,237 B2 2/2005 Surowiecki
6,966,945 B1 11/2005 Mazany et al.
6,969,422 B2 11/2005 Mazany et al.
D518,186 S 3/2006 Zarb
7,028,444 B2 4/2006 Wirth
7,043,880 B2 5/2006 Morgan et al.
7,059,092 B2 6/2006 Harkins
7,094,285 B2 8/2006 Mazany et al.
7,140,155 B1 11/2006 Nasimov
7,152,385 B2 12/2006 Morgan et al.
7,207,148 B2 4/2007 Surowiecki
7,240,905 B1 7/2007 Stahl, Sr.
7,284,355 B2 10/2007 Becker et al.
7,406,805 B1 8/2008 Larson
7,451,573 B2 11/2008 Orszulak et al.
7,479,513 B2 1/2009 Reinheimer et al.
7,526,897 B2 * 5/2009 Collins ..... E06B 1/62 52/211
7,617,643 B2 11/2009 Pilz et al.
7,669,383 B2 3/2010 Darnell

(56) References Cited

U.S. PATENT DOCUMENTS 7,681,365 B2 3/2010 Klein
7,735,295 B2 6/2010 Surowiecki
7,752,817 B2 7/2010 Pilz et al.
7,757,450 B2 7/2010 Reyes et al.
7,775,006 B2 8/2010 Giannos
7,797,893 B2 9/2010 Stahl, Sr. et al.
7,810,289 B2 10/2010 Montgomery
7,814,718 B2 10/2010 Klein
7,856,781 B2 12/2010 Hilburn, Jr.
D631,175 S 1/2011 Munoz Escribano
7,866,108 B2 1/2011 Klein
7,874,123 B2 1/2011 Maziarz
7,882,672 B2 2/2011 Emblin
7,921,603 B2 4/2011 Darnell
7,950,198 B2 5/2011 Pilz et al.
8,020,352 B2 9/2011 Ahearn
8,047,550 B2 11/2011 Behrens et al.
8,056,293 B2 11/2011 Klein
8,079,188 B2 12/2011 Swartz et al.
8,079,190 B2 12/2011 Hilburn, Jr.
8,087,205 B2 * 1/2012 Pilz ..... E04B 1/948 52/232
8,132,376 B2 3/2012 Pilz et al.
8,136,314 B2 3/2012 Klein
8,142,879 B2 3/2012 Whitaker et al.
8,151,526 B2 4/2012 Klein
8,181,404 B2 5/2012 Klein
8,230,659 B2 7/2012 Langille et al.
8,245,471 B2 8/2012 Hilburn, Jr.
8,281,552 B2 10/2012 Pilz et al.
8,322,094 B2 12/2012 Pilz et al.
8,347,794 B2 1/2013 Muirhead
8,353,139 B2 1/2013 Pilz et al.
8,375,666 B2 2/2013 Stahl, Jr. et al.
8,413,394 B2 4/2013 Pilz et al.
8,444,790 B2 5/2013 Tong
8,468,759 B2 6/2013 Klein
8,484,916 B2 7/2013 Farag
8,499,512 B2 8/2013 Pilz et al.
8,555,566 B2 10/2013 Pilz et al.
D693,483 S 11/2013 Krieger
8,572,914 B2 11/2013 Burgess
8,584,415 B2 11/2013 Stahl, Jr. et al.
8,590,231 B2 * 11/2013 Pilz ..... E04B 2/7411 52/232
8,595,999 B1 * 12/2013 Pilz ..... E04B 1/943 52/232
8,596,007 B2 12/2013 Hibbs
8,601,760 B2 12/2013 Hilburn
8,607,519 B2 12/2013 Hilburn
8,615,944 B2 12/2013 Maziarz
8,640,415 B2 2/2014 Pilz et al.
8,646,235 B2 2/2014 Hilburn, Jr.
8,663,774 B2 3/2014 Fernando et al.
8,671,632 B2 3/2014 Pilz et al.
8,720,138 B2 5/2014 Hilburn, Jr.
8,752,354 B2 6/2014 Honey
8,782,977 B2 7/2014 Burgess
8,793,947 B2 * 8/2014 Pilz ..... E04B 2/7457 52/232
8,826,599 B2 9/2014 Stahl, Jr.
8,869,491 B2 * 10/2014 Little ..... E04F 13/06 52/255
8,938,882 B2 1/2015 Carlson et al.
8,938,922 B2 1/2015 Pilz et al.
8,938,926 B2 1/2015 Sareyka et al.
8,955,275 B2 2/2015 Stahl, Jr.
8,973,319 B2 3/2015 Pilz et al.
9,045,899 B2 * 6/2015 Pilz ..... E04B 2/7411
9,062,453 B1 6/2015 Maziarz
9,085,907 B2 * 7/2015 Rutherford ..... E04F 13/06
9,127,454 B2 9/2015 Pilz et al.
9,157,232 B2 10/2015 Stahl, Jr.
D750,806 S 3/2016 Singh
9,272,499 B2 3/2016 Veilleux et al.
9,279,040 B2 3/2016 Jin et al.
9,279,247 B2 3/2016 Maziarz
9,290,932 B2 3/2016 Pilz et al.
9,290,934 B2 3/2016 Pilz et al.
9,321,243 B2 4/2016 Fernando et al.
9,371,644 B2 * 6/2016 Pilz ..... E04B 1/948
D761,971 S 7/2016 Apanovich et al.
D762,310 S 7/2016 Apanovich et al.
9,394,423 B2 7/2016 Easteal et al.
9,458,628 B2 10/2016 Pilz et al.
9,481,998 B2 11/2016 Pilz et al.
9,506,246 B2 11/2016 Joseph et al.
9,512,614 B2 12/2016 Klein et al.
9,523,193 B2 12/2016 Pilz
9,540,808 B2 * 1/2017 Remmele ..... E04F 13/068
9,611,640 B2 4/2017 Mayer et al.
9,616,259 B2 4/2017 Pilz et al.
9,637,914 B2 5/2017 Pilz et al.
9,683,364 B2 * 6/2017 Pilz ..... E04B 1/948
9,719,253 B2 8/2017 Stahl et al.
9,732,853 B2 8/2017 Kethorn et al.
9,739,052 B2 8/2017 Pilz et al.
9,739,054 B2 8/2017 Pilz et al.
9,752,318 B2 9/2017 Pilz
9,752,327 B2 9/2017 Poradzisz
9,879,421 B2 1/2018 Pilz
9,909,298 B2 3/2018 Pilz
9,931,527 B2 4/2018 Pilz et al.
9,995,039 B2 6/2018 Pilz et al.
9,995,040 B2 6/2018 Stahl et al.
10,000,923 B2 6/2018 Pilz
10,011,983 B2 7/2018 Pilz et al.
10,066,385 B2 9/2018 Foerg et al.
10,077,550 B2 * 9/2018 Pilz ..... E04B 2/7411
10,184,246 B2 * 1/2019 Pilz ..... E04B 2/7411
10,267,036 B2 4/2019 Kleinhans et al.
10,323,411 B2 6/2019 Ackerman et al.
2002/0139060 A1 * 10/2002 Contreras ..... E04B 1/762 52/101
2003/0051422 A1 3/2003 Maziarz
2005/0031843 A1 2/2005 Robinson et al.
2005/0034389 A1 2/2005 Boot
2005/0142359 A1 6/2005 Narum et al.
2005/0284030 A1 12/2005 Autovino et al.
2006/0096200 A1 5/2006 Daudet
2007/0209306 A1 9/2007 Andrews et al.
2008/0104918 A1 5/2008 Gleeson et al.
2008/0263971 A1 * 10/2008 Maziarz ..... E04F 17/08 52/204.1
2009/0239067 A1 9/2009 Verlaan
2009/0255619 A1 10/2009 Tong
2011/0088918 A1 4/2011 Gonzales
2011/0214371 A1 9/2011 Klein
2012/0022201 A1 1/2012 Zhvanetskiy et al.
2012/0023846 A1 2/2012 Mattox et al.
2012/0110936 A1 * 5/2012 Egan ..... E04F 13/06 52/255
2013/0205696 A1 * 8/2013 Little ..... E04F 13/06 52/255
2014/0230359 A1 8/2014 Honey
2014/0245676 A1 9/2014 Maziarz
2014/0345886 A1 11/2014 Yano et al.
2015/0135622 A1 5/2015 Muenzenberger et al.
2015/0135631 A1 * 5/2015 Foerg ..... E04B 2/7411 52/717.04
2015/0275506 A1 10/2015 Klein et al.
2015/0275507 A1 10/2015 Klein et al.
2015/0275510 A1 10/2015 Klein et al.
2016/0017599 A1 1/2016 Klein et al.
2016/0068689 A1 3/2016 Lang
2016/0186481 A1 6/2016 Maziarz
2016/0332345 A1 11/2016 Muenzenberger
2016/0340908 A1 * 11/2016 Apanovich ..... E04F 13/068
2016/0348357 A1 12/2016 Smith et al.
2017/0022704 A1 1/2017 Bertucelli et al.
2017/0044442 A1 2/2017 Muenzenberger et al.
2017/0130462 A1 5/2017 Maziarz
2017/0175386 A1 6/2017 Pilz

(56) References Cited

U.S. PATENT DOCUMENTS

| | | | | |
|---|---|---|---|---|
| 2017/0234010 | A1 | 8/2017 | Klein | |
| 2017/0260741 | A1 | 9/2017 | Ackerman et al. | |
| 2017/0306615 | A1 | 10/2017 | Klein et al. | |
| 2017/0314257 | A1 | 11/2017 | Foerg et al. | |
| 2018/0044913 | A1 | 2/2018 | Klein et al. | |
| 2018/0051470 | A1* | 2/2018 | Smith | E04F 19/061 |
| 2018/0112392 | A1 | 4/2018 | Hulteen et al. | |
| 2018/0171624 | A1 | 6/2018 | Klein et al. | |
| 2018/0195282 | A1 | 7/2018 | Pilz | |
| 2018/0202147 | A1 | 7/2018 | Klein et al. | |
| 2018/0283000 | A1 | 10/2018 | Klein | |
| 2018/0289994 | A1 | 10/2018 | Pilz et al. | |
| 2018/0363293 | A1 | 12/2018 | Pilz | |
| 2018/0371748 | A1 | 12/2018 | Klein | |
| 2019/0177970 | A1 | 6/2019 | Ackerman et al. | |
| 2019/0203464 | A1 | 7/2019 | Kleinhans et al. | |

FOREIGN PATENT DOCUMENTS

| | | | |
|---|---|---|---|
| CA | 2230408 | A1 | 8/1999 |
| CA | 2234347 | A1 | 10/1999 |
| CA | 2394592 | A1 | 1/2004 |
| CA | 2856523 | A1 | 2/2008 |
| CA | 2803439 | A1 | 8/2013 |
| CA | 2659845 | C | 11/2014 |
| CA | 2849597 | A1 | 12/2014 |
| CA | 2925428 | A1 | 5/2015 |
| CA | 165350 | S | 8/2016 |
| CA | 165351 | S | 8/2016 |
| DE | 102013025348 | A1 | 10/2014 |
| EP | 0723064 | A2 | 7/1996 |
| EP | 2 821 207 | A1 | 1/2015 |
| EP | 2 933 312 | A1 | 10/2015 |
| EP | 3 056 626 | A1 | 8/2016 |
| FR | 2742186 | A1 | 6/1997 |
| GB | 2070114 | A | 9/1981 |
| GB | 2284218 | A | 5/1995 |
| GB | 2356885 | A | 6/2001 |
| GB | 2405172 | A | 2/2005 |
| JP | 53-64003 | B2 | 12/2013 |
| KR | 2010-0106615 | A | 10/2010 |
| NL | 1037340 | C | 4/2011 |
| TW | M 354518 | U | 4/2009 |
| WO | WO 2004/044927 | A1 | 5/2004 |
| WO | WO 2012/131284 | A1 | 10/2012 |
| WO | WO 2014/154729 | A1 | 10/2014 |
| WO | WO 2015/001001 | A1 | 1/2015 |
| WO | WO 2015/015206 | A1 | 2/2015 |
| WO | WO 2015/071482 | A1 | 5/2015 |
| WO | WO 2015/158651 | A1 | 10/2015 |
| WO | WO 2016/128301 | A1 | 8/2016 |
| WO | WO 2016/128304 | A1 | 8/2016 |
| WO | WO 2016/128552 | A1 | 8/2016 |

OTHER PUBLICATIONS

Canadian Industrial Design Certificate of Registration dated Dec. 2018 for Registration No. CA 178,867 S; titled: L-Bead with a Backing Strip; applicant: Clarkwestem Dietrich Building Systems, LLC; 15 pgs.

Canadian Filing Certificate dated Dec. 20, 2017 for CA 2,989,713; titled: Finishing Accessory with Backing Strip; applicant: Clarkwestem Dietrich Building Systems, LLC; 1 pg.

European Union Certificate of Registration for the Registered Community Design No. 004558666-0001, Registered Dec. 20, 2017, on behalf of Clarkwestem Dietrich Building Systems LLC, 9 pgs.

European Union Certificate of Registration for the Registered Community Design No. 004558666-0002, Registered Dec. 20, 2017, on behalf of Clarkwestem Dietrich Building Systems LLC, 9 pgs.

European Union Certificate of Registration for the Registered Community Design No. 004558666-0003, Registered Dec. 20, 2017, on behalf of Clarkwestem Dietrich Building Systems LLC, 9 pgs.

European Union Certificate of Registration for the Registered Community Design No. 004558666-0004, Registered Dec. 20, 2017, on behalf of Clarkwestem Dietrich Building Systems LLC, 9 pgs.

"Archmaker™ Casing Beads", Vinyl Corp., 2015, 1 pg., downloaded Nov. 16, 2015 from http://www.vinylcorp.com/products/stucco-plaster/casine-beads/archmaker-casing-beads.

"Archmaker™/Bandmaker™ Casing Beads", Vinyl Corp., 2015, 1 pg., downloaded Nov. 16, 2015 from http://www.vinylcorp.com/products/stucco-plaster/casing-beads/archmaker-bandmaker-casing-beads.

"Bandmaker Series Casing Beads", Vinyl Corp., 2015, 1 pg, downloaded Nov. 16, 2015 from http://ww.vinylcorp.com/products/stucco-plaster/casing-beads/bandmaker-series-casing-beads.

"BM 66 Series 1-Piece Bandmaker", Vinyl Corp., 2015, 1 pg., downloaded Nov. 16, 2015 from http://www.vinylcorp.com/products/stucco-plaster/casing-beads/bm-66-series-1-piece-bandmaker.

"Double Ground (Bandmaker™ Series)", Vinyl Corp., 2015, 1 pg., downloaded Nov. 16, 2015 from http://www.vinylcorp.com/products/stucco-plaster/casing-beads/double-ground-bandmaker-series.

"#66N Short Flange Casing Bead", ClarkDietrich, 2015, 1 pg., downloaded Nov. 16, 2015 from http//www.clarkdietrich.com/products/metal-corner-casing-beads/66n-short-flange-casing-bead.

"#66N Zinc Short Flange Casing Bead", ClarkDietrich, 2015, 1 pg., downloaded Nov. 16, 2015 from http://www.clarkdietrich.com/products/zinc-corner-casing-beads/66n-zinc-short-flange-casing-bead.

"#66X Expanded Flange Casing Bead", ClarkDietrich, 2015, 1 pg., downloaded Nov. 16, 2015 from http://www.clarkdietrich.com/products/metal-corner-casing-beads/66x-expnaded-flange-casing-bead.

"#66X Zinc Expanded Flange Casing Bead", ClarkDietrich, 2015, 1 pg., downloaded Nov. 16, 2015 from http://www.clarkdietrich.com/producys/zinc-corner-casing-beads/66x-zinc-expanded-flange-casing-bead.

"Angled Casing Beads", Vinyl Corp., 2015, 1 pg., downloaded Nov. 16, 2015 from http://www.vinylcorp.com/products/stucco-plaster/casing-beads/angled-casing-beads.

"BackerBead™," Vinyl Corp., 2015, 1 pg., downloaded Dec. 6, 2016 from http://vinylcorp.com/products/stucco-plaster/casing-beads/backerbead%E2%84%A2.

"BackerBead™ Drip Flashing—3 1/2" Flange," ClarkDietrich, Dec. 2017, 2 pgs., (https://web.archive.org/web/20171210150830/http://www.vinylcorp.com/products/stucco-plaster/casing-beads/backerbead™-drip-flashing-3-12-flange).

"Bullnose Casing Beads", Vinyl Corp., 2015, 1 pg., downloaded Nov. 16, 2015 from http://www.vinylcorp.com/products/stucco-plaster/casing-beads/bullnose-casing-beads.

"Casing Beads / Plaster Stops", Vinyl Corp., 2015, 1 pg., downloaded Nov. 16, 2015 from http://www.vinylcorp.com/products/stucco-plaster/casing-beads/casing-beads-plaster-stops.

"Casing Beads with Reveal", Vinyl Corp., 2015, 1 pg., downloaded Nov. 16, 2015 from htip://www.vinylcorp.com/products/stucco-plaster/casing-beads/casing-beads-reveal.

"Casing Beads with Weep Holes", Vinyl Corp., 2015, 1 pg., downloaded Nov. 16, 2015 from http://www.vinylcorp.com/products/stucco-plaster/casing-beads/casing-beads-weep-holes.

"Casing Beads (with Weep Holes for 1/2" Sheathing)", Vinyl Corp., 2015, 1 pg., downloaded Nov. 16, 2015 from http://www.vinylcorp.com/products/stucco-plaster/casing-beads/casing-beads-weep-holes-12-sheathing.

"DEFS Casing Beads," Vinyl Corp., 2015, 1 pg. downloaded Jan. 28, 2016 from http://www.vinylcorp.com/products/eifs-defs/defs-casing-beads/defs-casing-beads.

"DEFS Casing Beads (w-Drip)," Vinyl Corp., 2015, 1 pg. downloaded Jan. 28, 2016 from http :/7www.vi nvtcorp.com/products/etfe-defs/defs-castng-beads/defs-cas tng-beads-w-.

"DEFS Casing Beads (w-Weep)," Vinyl Corp., 2015, 1 pg. downloaded Jan. 28, 2016 from http://www.vinylcorp.com/products/eifs-defs/defs-casing-beads/defs-casing-beads-w-weep.

(56) References Cited

OTHER PUBLICATIONS

"DEFS Weeped Starter Strip/Casing Beads (w-Drip)," Vinyl Corp., 2015, 1 pg., downloaded Feb. 16, 2016 from http://vinylcorp.com/products/eifs-defs/defs-starter-strip/defs-weeped-starter-stripcasing-beads.
"Drip Casing Bead," Vinyl Corp., 2014, 1pg., downloaded Feb. 5, 2018 from http://www.vinylcorp.com/products/stucco-plaster/drip-screed-reveals/drip-casing-beads.
"Drip Casing Bead," Vinyl Corp., 2015, 1 pg., downloaded Jan. 28, 2016 from http://wws.vinylcorp.com/products/eifs-defs/eifs-casing-beads/drip-casing-bead.
""F" Beads," Vinyl Corp., 2015, 1 pg. downloaded Jan. 28, 2016 from http://www.vinylcorp.com/products/drywall-veneer/beads-trims/f-beads.
""J" Beads," Vinyl Corp., 2015, 1 pg. downloaded Jan. 28, 2016 from http://www.vinylcorp.com/products/drywall-veneer/beads-trims/j-beads.
"Muddable "J" Beads," Vinyl Corp., 2015, 1 pg. downloaded Jan. 28, 2016 from http://www.vinylcorp.com/products/drywall-veneer/beads-trims/muddable-j-beads.
"Muddable "J" Beads," Vinyl Corp., 2015, 1 pg. downloaded Jan. 28, 2016 from http://www.vinylcorp.com/products/eifs-defs/defs-j-beads/muddable-j-beads.
"Muddable "J" Beads (with removable leg)," Vinyl Corp., 2015, 1 pg. downloaded Jan. 28, 2016 from http://www.vinylcorp.com/products/drywall-veneer/beads-trims/muddable-j-beads-removable-leg.
""L" Beads (L-Bead Perforated)," Vinyl Corp., 2015, 1 pg. downloaded Jan. 28, 2016 from http://www.vinylcorp.com/products/drywall-veneer/beads-trims/1-beads-1-bead-perforated.
"DEFS 45 Degree L-Bead," Vinyl Corp., 2015, 1 pg. downloaded Jan. 28, 2016 from http://www.vinylcorp.com/products/eifs-defs/defs-l-beads/defe-45-degree-l-bead.
"DEFS L Stop Casing Beads (w-Splice)," Vinyl Corp., 2015, 1 pg. downloaded Jan. 28, 2016 from http://www.vinylcorp.com/products/eifs-defs/defs-1-beads/defs-1-stop-casing-beads-w-splice.
"DEFS L Stop Casing Beads," Vinyl Corp., 2015, 1 pg. downloaded Jan. 28, 2016 from http://www.vinylcorp.com/products/eifs-defs/defs-1-beads/defs-1-stop-casing-beads.
"Long Flange Casing Beads/Plaster Stops", Vinyl Corp., 2015, 1 pg., downloaded Nov. 16, 2015 from http://www.vinylcorp.com/products/stucco-plaster/casing-beads/long~flange-casing-beads-plaster-stops.
"PB Standard Starter Strip/Casing Beads (3/32" Finish)," Vinyl Corp., 2015, 1 pg., downloaded Feb. 16, 2016 from http://vinylcorp.com/products/eifs-defs/eifs-starter-strips/pb-standard-starter-stripcasing-beads-332-finish.
"PB Starter Strip/Casing Beads (1/16" Finish)," Vinyl Corp., 2015, 1 pg., downloaded Feb. 16, 2016 from http://vinylcorp.com/products/eifs-defs/eifs-starter-strips/pb-starter-stripcasing-beads-116-finish.
"PB Starter Strip/Casing Beads (w-Drip & Weep 1/16" Finish)," Vinyl Corp., 2015, 1 pg., downloaded Feb. 16, 2016 from http://vinylcorp.com/products/eifs-defs/eifs-starter-strips/ph-starter-stripcasing-beads-w-drip-weep-116-finish.
"PB Starter Strip/Casing Beads (w-Drip 1/16" Finish)," Vinyl Corp., 2015, 1 pg., downloaded Feb. 16, 2016 from http://vinylcorp.com/products/eifs-defs/eifs-starter-strips/pb-starter-stripcasing-beads-w-drip-116-finish.
"PB Starter Strip (Back Weep Holes 3/32" Finish)," Vinyl Corp., 2015, 1 pg., downloaded Feb. 16, 2016 from http://vinylcorp.com/products/eifs-defs/eifs-starter-strips/pb-starter-strip-back-weep-332-finish.
"PB Starter Strip (Front & Back Weep Holes 3/32" Finish)," Vinyl Corp., 2015, 1 pg., downloaded Feb. 16, 2016 from http://vinylcorp.com/products/eifs-defs/eifs-starter.strips/ph-starter-strip-front-back-weep-332.finish.
"PB Starter Strip (Front Weep Holes 3/32" Finish)," Vinyl Corp., 2015, 1 pg., downloaded Feb. 16, 2016 from http://vinylcorp.com/products/eifs-defs/eifs-starter-strips/pb-starter-strip-front-back-weep-332-finish.
"PB Header Weeped Starter Strip," Vinyl Corp., 2015, 1 pg., downloaded Feb. 16, 2016 from http://vinyl.com/products/eifs-defs/eifs-starter-strips/pb-header-weeped-starter-strip.
"PM Casing Bead," Vinyl Corp., 2015, 1 pg. downloaded Jan. 28, 2016 from http://www.vinylcorp.com/products/eifs~defs/eifs-casing-beads/pm-casing-beads.
"PM Starter Strip/Casing Beads," Vinyl Corp., 2015, 1 pg., downloaded Feb. 16, 2016 from http://vinylcorp.com/products/eifs-defs/eifs-starter-strips/pm-starter-stripcasing-bead.
"PM Starter Strip (Reinforced)," Vinyl Corp., 2015, 1 pg., downloaded Feb. 16, 2016 from http:vinylcorp.com/products/eifs~defs/eifs-starter-strips/pm-starter~strip~reinforced.
"PM Starter Strip/Casing Beads (w-Front Weep Holes)," Vinyl Corp., 2015, 1 pg., downloaded Feb. 16, 2016 from http://www.vinylcorp.com/products/eifs-defs/eifs-starter-strips/pm-starter-stripcasing-bead-w-front-weep-holes.
"Step Bead", Vinyl Corp., 2015, 2 pgs., downloaded Nov. 16, 2015 from http://www.vinylcorp.com/products/stucco-plaster/casing-beads/step-bead.
"Vinyl Casing Bead/Plaster Stop", ClarkDietrich, 2015, 1 pg., downloaded Nov. 16, 2015 from http://www.clarkdietrich.com/products/vinyl-corner-casing-beads/vinyl-casing-beads-plaster-stop.
"Weeped Starter Track," Vinyl Corp., 2014, 1 pg., downloaded Feb. 5, 2018 from http://www.vinylcorp.com/products/eifs-defs/eifs~starter-tracks/weeped-starter-track.
"XL Long Flange Casing Beads/Plaster Stops", Vinyl Corp., 2015, 1 pg., downloaded Nov. 16, 2015 from http://www.vinylcorp.com/producls/stucco-plaster/casing-beads/xl-long-flange-casing-beads-plaster-stops.
"2" J-Weep Low Back, ClarkDietrich, 2015, 1 pg. downloaded Jan. 28, 2016 from http://www.clarkdietrich.com/products/metal-weep-sill-screeds/2-j-weep-low-back.
"3-1/2 " J-Weep High Back, ClarkDietrich, 2015, 1 pg. downloaded Jan. 28, 2016 from http://www.clarkdietrich.com/products/metal-weep-sill-screeds/3-1-2-j-weep-high-back.
"#701A/#801A J-Trim," ClarkDietrich, 2015, 1 pg., downloaded Feb. 16, 2016 from http://www.clarkdietrich.com/products/metal-veneer-plaster-beads-trims/701a-801a-j-trim.
"#701A/#801A Zinc J-Trim," ClarkDietrich, 2015, 1 pg. downloaded Jan. 28, 2016 from http://www.clarkdietrich.com/products/zinc-veneer-plaster-beads-trims/701a-801a-zinc-j-trim.
"#701B/#801B L-Trim," ClarkDietrich, 2015, 1 pg., downloaded Feb. 16, 2016 from http://www.clarkdietrich.com/products/metal-veneer-plaster-beads-trims/701b-801b-1-trim.
"#701B/#801B Zinc L-Trim," ClarkDietrich, 2015, 1 pg. downloaded Jan. 28, 2016 from http://www.clarkdietrich.com/products/zinc-veneer-plaster-beads-trims/701b-801b-zinc-1-trim.
"Adjustable Corner Trim," Vinyl Corp., 2015, 1 pg. downloaded Jan. 28, 2016 from http://www.vinylcorp.com/products/drywall-veneer/beads-trims/adjustable-corner-trim.
"Ceiling Trim Surface Mount (L-Bead Perforated)," Vinyl Corp., 2015, 1 pg. downloaded Jan. 28, 2016 from http://www.vinylcorp.com/products/drywall-veneer/beads-trims/ceiling-trim-surface-mount-1-bead-perforated.
"Ceiling Trims (L-Bead Perforated)," Vinyl Corp., 2015, 1 pg. downloaded Jan. 28, 2016 from http//www.vinylcorp.com/products/drywall-veneer/beads-trims/ceiling-trims-1-bead-perforated.
"D-66 Drop Plaster Stop", Vinyl Corp., 2015, 1 pg., downloaded Nov. 16, 2015 from http://www.vinylcorp.com/products/stucco-plaster/casing-beads/d-66-drop-plaster-stop.
"Female Casing Expansion Joint," ClarkDietrich, 2015, 1 pg. downloaded Jan. 28, 2016 from http://www.clarkdietrich.com/products/vinyl-expansion-control-joints/female-casing-expansion-joint.
"Backer Rod Products," Best Materials discount warehouse, Mar. 2016, 9 pgs., (https://web.archive.org/web/20160301082146/https://www.bestmaterials.com/Backer Rod.aspx).
"Caulking Tips: Use Backer Rod," Sashco, Inc., Oct. 2017, 3 pgs., (http://blog.sashco.com/blog/use-less-caulking-save-money).
"FAS Reveal—18 MIL," Product Data Sheet, CEMCO, Aug. 29, 2016. 1 pg.

(56) References Cited

OTHER PUBLICATIONS

"FAS-RBR (Rated Base Reveal)," CEMCO, Product Data Sheet, Sep. 2016, 1 pg. (https://cemcosteel.com/steel-framing/fas-wall-products/fas-rated-base-reveal-rbr).
"FAS-RBR Strap (Rated Base Reveal)," CEMCO, Product Data Sheet, Sep. 2016, 1 pg. (https://cemcosteel.com/steel-framing/fas-wall-products/fas-rbr-strap).
"CEMCO Hotrod Type-X Compressible Firestopping," CEMCO, Product Data Sheet, May 2019, 1 pg. (https://cemcosteel.com/steel-framing/head-wall/hot-rod-type-x).
"CEMCO Smoke and Sound Stop," CEMCO, Product Data Sheet, Aug. 2017, 1 pg. (https://cemcosteel.com/steel-framing/head-wall/fas-fas%c2%ac-track-1000-and-dda%c284%a2-head-wall-systems/smoke-and-sound-stop).
EcoStud, "Product Details," downloaded Aug. 28, 2017 from http://ecostud.com/product-details, 1 pg.
EcoStud, "EcoStud® Track and Stud System," Drawing No. 11-5043-1, dated May 11, 2011, downloaded Aug. 28, 2017 from http://ecostud.com/sites/default/files/stud_11-5043-1.pdf, 1 pg.
EcoStud, "EcoStud® Track and Stud System," Drawing No. 11-5031-4, dated May 11, 2011, downloaded Aug. 28, 2017 from http://ecostud.com/sites/default/files/track_11-5031-4.pdf, 1 pg.
STI Product Data Sheet, SpeedFlex© Series TTG Track Top Gasket, FOD-5181-0434, 2016, 1 pg.
"Ceiling Mounted Deflection Bead," Trim-Tex Drywall Products, Jun. 2016, 1 pg. (https://web.archive.org/web/20160619064021/http://www.trim-tex.com/products/overview/commercial-beads/deflection-beads/ceiling-mounted-deflection-bead/).
"Wall Mounted Deflection Bead," Trim-Tex Drywail Products, Jul. 2016, 1 pg. (https://web.archive.org/web/20160710062112/https://www.trim-tex.com/products/overview/commercial-beads/deflection-beads/wall-mounted-deflection-bead/).
"E-Z Bead™ Vinyl Casing Bead," AMICO Building Products, Mar. 2016, 3 pgs., (https://web.archive.org/web/20160331140912/http://amico-lath.com/e-z-bead.htm).
"Penetration Sealant Recommendations, Exterior Systems 600-300," Northwest Wall and Ceiling Bureau, Dec. 2005, 1 pg., (http://web.nweb.org/CWT/External/WCPages/WCWebContent/WebContentPage.aspx?ContentID=116).
"Track Within a Track Deflection Assembly," Industry Technical Note, Cold Formed Steel Construction, Steel Stud Manufactures Association (SSMA), Apr. 2000, 4 pgs. (http://www.customstud.com/pdfs/tech_Notes_Details.pdf).
Letter dated May 20, 2015 to Ryan Smith, Vinyl Corp., from John F.A. Earley III, Esq., Law Offices of Harding, Earley, Follmer & Frailey, P.C., re: Infringement of U.S. Pat. Nos. 8,615,944 and 7,874,123, 19 pgs.
Letter dated Jun. 9, 2015 to John F.A. Earley, III, Esq., Law Offices of Harding, Earley, Follmer & Frailey, P.C., from Ann Schoen, Esq., Frost Brown Todd LLC, re: U.S. Pat. Nos. 8,615,944 and 7,874,123, 5 pgs.
Letter dated Mar. 10, 2016 to Ann Schoen, Esq., Frost Brown Todd LLC, from M. Joseph Clement, Esq., Wisler Pearlstine, LLP, re: EZ Bead U.S. Pat. Nos. 8,615,944; 7,874,123; and 9,279,247; and U.S. Appl. No. 1/259,499, 16 pgs.
Letter dated Mar. 25, 2016 to M. Joseph Clement, Esq., Wisler Pearlstine, LLP, from Ann Schoen, Esq., Frost Brown Todd LLC, re: U.S. Pat. Nos. 9,279,247; 8,615,944; and 7,874,123, 2 pgs.
UL Certification, System No. HW-D-0277, XHBN.HW-D-0277, Joint Systems, Effective Apr. 20, 2010, 3 pgs.
UL Certification, System No. HW-S-0004, XHBN.HW-S-0004, Joint Systems, Effective Sep. 8, 2004, 2 pgs.
US Office Action dated Feb. 22, 2017 for U.S. Appl. No. 15/083,724, 14 pgs.
U.S. Appl. No. 10/602,198, filed Jun. 24, 2003, by Collins et al., entitled: Jamb and Header Surround for Masonry Wall.
U.S. Appl. No. 11/259,499, filed Oct. 26, 2005, by Maziarz, entitled: Stop Bead for Separating Stucco Matieral From a Frame of a Window or Door.
Design U.S. Appl. No. 29/597,188, filed Mar. 15, 2017 by Apanovich et al., entitled: Drip Flange With Backing Strip.
U.S. Appl. No. 60/637,379, filed Dec. 20, 2004 by Klein.
U.S. Appl. No. 60/954,029, filed Aug. 6, 2007 by Pilz.
U.S. Appl. No. 60/957,434, filed Aug. 22, 2007 by Pilz.
U.S. Appl. No. 60/997,521, filed Oct. 4, 2007 by Klein.
U.S. Appl. No. 61/007,439, filed Dec. 13, 2007 by Klein.
U.S. Appl. No. 61/021,418, filed Jan. 16, 2008 by Pilz.
U.S. Appl. No. 61/244,277, filed Sep. 21, 2009 by Pilz.
U.S. Appl. No. 61/379,047, filed Sep. 1, 2010 by Pilz.
U.S. Appl. No. 61/461,383, filed Jan. 18, 2011 by Burgess.
U.S. Appl. No. 61/510,634, filed Jul. 22, 2011 by Burgess.
U.S. Appl. No. 61/589,188, filed Jan. 20, 2012 by Pilz.
U.S. Appl. No. 61/905,706, filed Nov. 18, 2013 by Foerg et al.
U.S. Appl. No. 61/905,711, filed Nov. 18, 2013 by Muenzenberger et al.
U.S. Appl. No. 61/972,943, filed Mar. 31, 2014 by Klein et al.
U.S. Appl. No. 61/972,956, filed Mar. 31, 2014 by Klein et al.
U.S. Appl. No. 61/972,969, filed Mar. 31, 2014 by Klein et al.
U.S. Appl. No. 61/996,866, filed May 16, 2014 by Stahl et al.
U.S. Appl. No. 61/998,187, filed Jun. 23, 2014 by Stahl et al.
U.S. Appl. No. 62/026,974, filed Jul. 21, 2014 by Klein et al.
U.S. Appl. No. 62/026,993, filed Jul. 21, 2014 by Klein et al.
U.S. Appl. No. 62/104,627, filed Jan. 16, 2015 by Pilz.
U.S. Appl. No. 62/313,606, filed Mar. 25, 2016 bv Pilz et al.
U.S. Appl. No. 62/389,856, filed Mar. 11, 2016 by Ackerman et al.
U.S. Appl. No. 62/391,984, filed May 16, 2016 by Ackerman et al.
U.S. Appl. No. 62/436,937, filed Dec. 20, 2016 by Stahl.
U.S. Appl. No. 62/509,400, filed May 22, 2017 by Stahl et al.
3M Fire Protection Products, "Applicators and Specifiers Guide, 3M™ Expantrol™ Flexible Intumescent Strip E-FIS," p. xviii, and "Article Information Sheet," 2014, downloaded from https://www.3m.com3M/en_US/company-us-all-3m-products/~/3M-Expantrol-Flexible-Intumescent-Strip-E-FIS/?N=5002385+3293123900&rt=rud. 4 pgs.
Grainger, "STI—Fire Barrier Foil Tape, 2" Width," 2015, downloaded from https://web.archive.org/web/20151001140949/https://www.grainger.com/product/STI-Fire-Barrier-Foil-Tape-4MM48, 2 pgs.
International Fireproof Technology, Inc. (IFTI), "HITS—High Intumescent Sheet—Paint to Protect," Information and Data Sheet, 2017, downloaded from https://www.painttoprotect.com/hits-intumescent-sheet/ 4 pgs.
International Fireproof Technology, Inc. (IFTI), "INFS0812 Intumescent Strip," Information and Data Sheet, 2018, https://www.painttoprotect.com/infs0812-intumescent-strip/ 5 pgs.
NOMACO, "NOMAFLEX® Polypropylene Joint Filler," 2016, downloaded from https://www.nomaco.com/wp-content/uploads/2016/09/cp_0030_nomaflex_0916.pdf, 2 pgs.
U.S. Appl. No. 61/253,059, filed Oct. 19, 2009 by Gonzales.

* cited by examiner

FINISHING ACCESSORY WITH BACKING STRIP

PRIORITY

This application claims priority to U.S. Provisional Patent Application Ser. No. 62/436,937, filed Dec. 20, 2016, entitled "FINISHING ACCESSORY WITH FIRE RESISTANT STRIP," and to U.S. Provisional Patent Application Ser. No. 62/509,400, filed May 22, 2017, entitled "FINISHING ACCESSORY WITH BACKING STRIP," the disclosures of which are incorporated by reference herein.

BACKGROUND

In typical building construction, framing assemblies, including studs, joists, trusses, etc., are combined with sheathing materials, such as wallboard panels, to form sheathing assemblies and are used to construct walls, ceilings and/or floors. The sheathing materials on their own may not provide the desired level of fire protection or sound insulation, particularly at the joints or ends of the sheathing assemblies, such as the joint formed between the top of a wall and the ceiling. As a result, additional materials, such as mineral wool, fire caulking, intumescent strips, intumescent putty, fire resistant foam, or other fire resistant or sound insulating materials may be installed at these joints in order to achieve the desired level of fire protection and/or sound insulation.

In addition, many walls are constructed to allow for vertical movement of the studs and the wallboard panels attached thereto relative to the ceiling, which may result from thermal expansion of the studs, seismic activity or shifting loads on higher floors or other similar factors. Typically, in those walls, the wallboard panels are installed such that there is a gap between the top of the wallboard panel and the horizontal support structure (e.g., ceiling). The gap allows the wallboard panel to travel vertically without contacting the ceiling when the studs and wallboard panel deflect. Those gaps are typically filled with a resilient and/or a compressible filler material, such as backer rod or caulk, so that the wallboard panel can still move vertically during a deflection. In some applications, the filled gap can then be covered by a finishing component, such as joint tape and joint compound.

In addition to applying a finishing component over the filler material in the gap, a finishing accessory, including but not limited to a piece of ceiling trim or an L bead, may also be installed at the top of the wallboard panel to help provide an aesthetically pleasing appearance to the joint. The finishing accessories may be manufactured from plastics, metals, paper products, composites and other materials.

Accordingly, providing a finishing accessory that comprises a backing strip that can fill the gap with a resilient and/or compressible material, may allow a single component to replace multiple components or materials, which may reduce installation time and total material cost.

While a variety of finishing accessories have been made and used, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
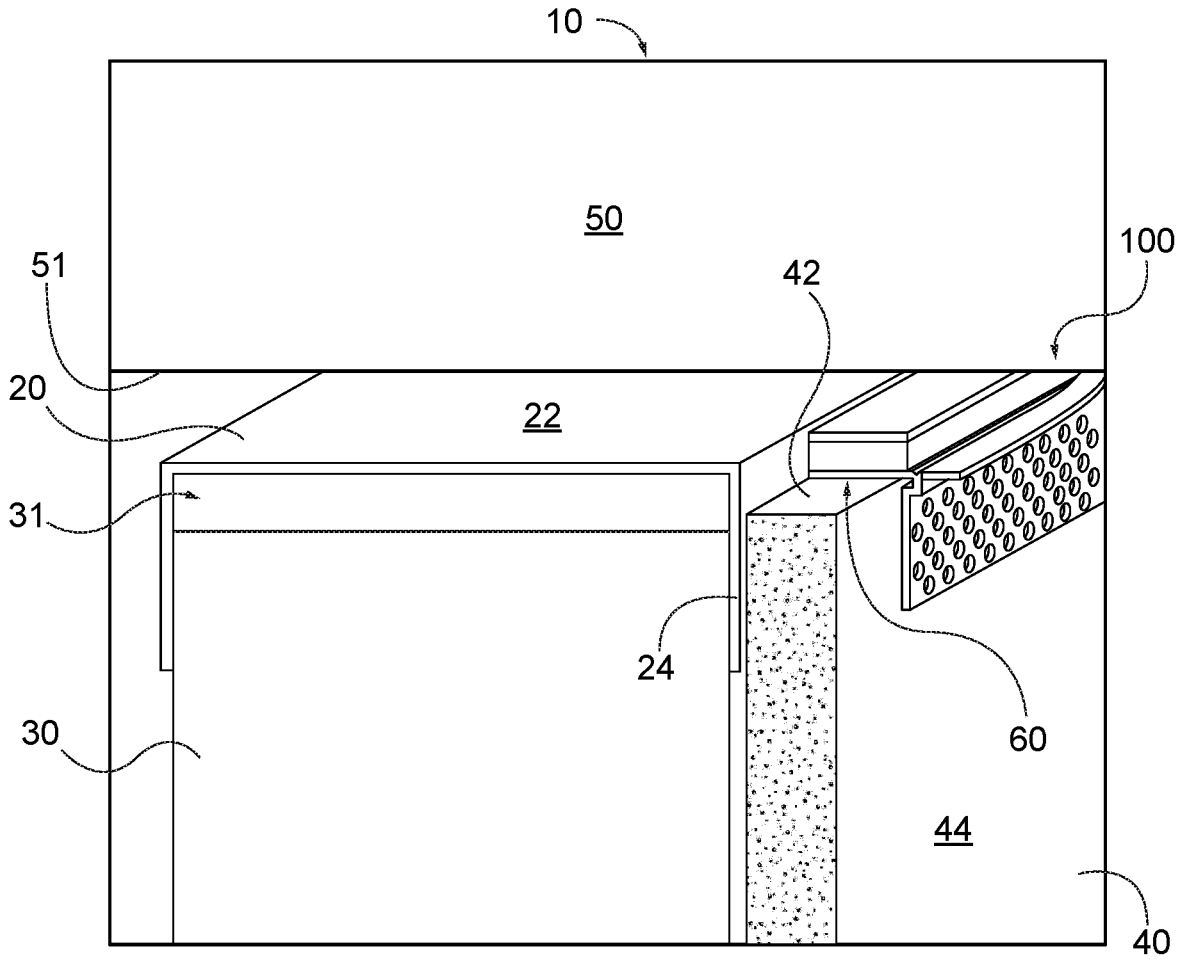
FIG. 1 depicts a partial perspective view of a wall assembly that includes an exemplary finishing accessory.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 shows a wall assembly (10) that includes a header track (20), a plurality of studs (30), a drywall or wallboard panel (40), and an exemplary finishing accessory (100). In some embodiments, the wall assembly may include two or more wallboard panels on a respective side of the wall assembly. Wall assembly (10) is constructed such that the upper end of each stud (30) is received within header track (20), the upper surface of a web (22) of header track (20) is installed against a horizontal support structure (50), and wallboard panel (40) is attached to stud (30) and positioned such that a gap (60) is formed between a top edge (42) of wallboard panel (40) and a lower surface (51) of horizontal support structure (50). As shown, gap (60) is defined by the top edge of wallboard panel (40) the lower surface (51) of horizontal support structure and the outer surface of the leg or flange (24) of header track (20). In this embodiment, gap (60) also includes an opening opposite the outer surface of the flange (24) of header track (20). In some embodiments, header track (20) may comprise one or more intumescent strips attached to one or both flanges (24) and/or web (22) of header track (20).

Wall assembly (10) may also include a footer track (not shown) that is vertically spaced apart from, and aligned with, header track (20). The footer track may be configured to receive a lower end (not shown) of each stud (30) of the plurality of studs (30). Header track (20) and the footer track may comprise either standard header and footer tracks (i.e., non-slotted or solid leg tracks) or slotted header and footer tracks. In some embodiments, each stud (30) of the plurality of studs (30) may be installed such that there is a gap (31) between the top of stud (30) and web (22) of header track (20). That gap (31) may comprise any suitable distance to allow for movement of studs (30) relative to header track (20) after installation, which may result from a variety of factors, including but not limited to thermal expansion of studs (30) or deflection of the horizontal support structure (50) due to seismic activity or loads on higher floors. The size of the gap (31) between the top of studs (30) and web (22) of header track (20) may correspond to the size of gap (60) between wallboard panel (40) and horizontal support structure (50). The size of gap (60) and the gap (31) between the top of studs (30) and web (22) of header track (20) may depend on the amount of deflection desired for a particular application. By way of example only, the size of gap (60) and the gap (31) between the top of studs (30) and web (22) of header track (20) may range from approximately ⅜ inches to approximately 3 inches. Other various suitable sizes for gap (60) and the gap between the top of studs (30) and web (22) will be apparent to those of ordinary skill in the art. In some embodiments, slotted header track (20) may also be used to allow for ceiling deflections resulting from seismic activity or loads on higher floors.

One or more of the footer track (not shown), header track (20), and studs (30) may comprise sheet metal, such as steel, stainless steel, aluminum or combinations thereof. In other instances, one or more of the footer track, header track (20) and studs (30) may comprise plastics, other polymer-based or reinforced materials, or combinations thereof. In addition, in some embodiments, wallboard panel (40) may comprise a sheet or panel of drywall, sheetrock, gypsum board, plasterboard or other similar construction materials. It will be appreciated that in a multi-story building, horizontal support structure (50) may serve as a ceiling for one floor of the building while also serving as a floor for an adjacent floor of the building. Horizontal support structure (50) may comprise any suitable support structure, including but not limited to, a concrete deck, a fluted metal deck, or a support beam.

Figure 2:
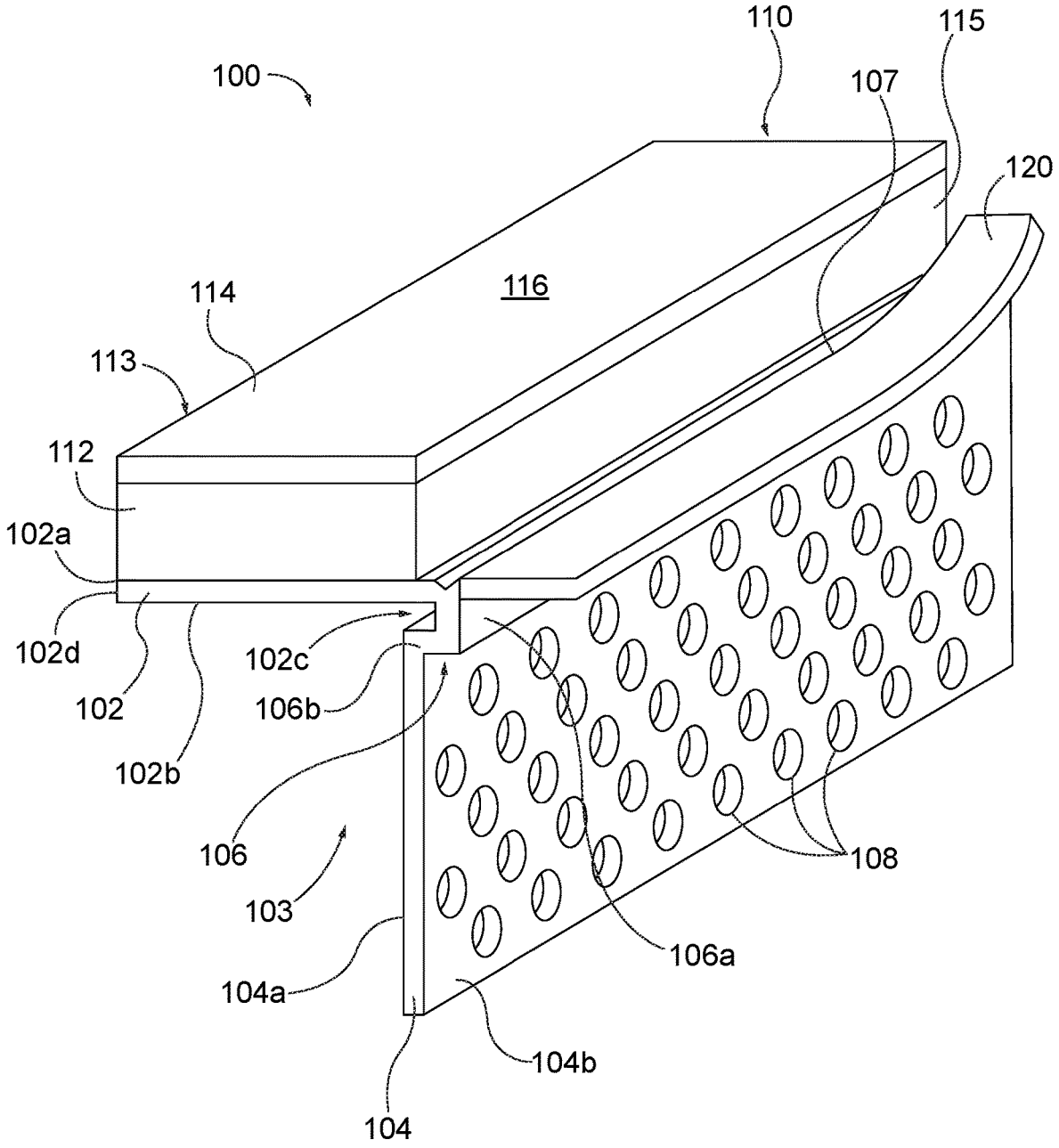
FIG. 2 depicts a top perspective view of the finishing accessory of FIG. 1.

In the embodiment illustrated in FIG. 2, finishing accessory (100) comprises a bead (103) that is an L-bead. As shown, bead (103) comprises a first leg (102), a second leg (104), and a lip (106) that connects first leg (102) and second leg (104) to form an L-bead. The profile of first leg (102) and second leg (104) joining at lip (106) forms a substantially "L" shaped profile. In this embodiment, first leg (102) comprises an exterior surface (102*a*) and an interior surface (102*b*) and second leg (104) similarly comprises an exterior surface (104*a*) and an interior surface (104*b*). As shown, first leg (102) is connected to lip (106) at a fixed end (102*c*) and comprises a free end (102*d*) opposite the fixed end. In the illustrated embodiment, lip (106) comprises a vertical leg (106*a*) and a horizontal return (106*b*) that results in second leg (104) being inwardly offset from vertical leg (106*a*) of lip (106). Finishing accessory (100) further comprises a backing strip (110) extending along first leg (102) and a removable leg (120) extending along lip (106). In other embodiments, the horizontal return (106*b*) of lip (106) may be omitted such that first leg (102) and second leg (104) form a juncture along a common edge between first leg (102) and second leg (104). In those embodiments, lip (106) would comprise the juncture along a common edge between first leg (102) and second leg (104). Finishing accessory (100) may comprise other various suitable shapes, configurations, or profiles for the bead portion (103). In addition, finishing accessory (100) may have any desired length and/or width.

In the illustrated embodiment, first leg (102) and second leg (104) are substantially perpendicular to each other and second leg (104) is a perforated leg that includes a plurality of openings (108). Openings (108) may be configured to facilitate application of a finishing material, such as joint compound, veneer plaster, paint, or other similar materials, over second leg (104) to obtain a flush finish of second leg (104) when positioned over wallboard panel (40). As shown, the plurality of openings (108) includes a plurality of rows of circular openings in second leg (104). It will be appreciated that any suitable number of openings (108) may be included in second leg (104) and that openings (108) may be arranged in any desired pattern and/or have any size and shape suitable to allow the finishing material to sufficiently engage both second leg (104) and support wallboard panel (40). In some embodiments, openings (108) may be omitted entirely. Openings (108) may also facilitate installation of finishing accessory (100) in wall assembly (10) by facilitating attachment of second leg (104) to wallboard panel (40) via fasteners (not shown) inserted through openings (108) and into wallboard panel (40). In some embodiments, second leg (104) may be attached to wallboard panel (40) via fasteners inserted through the solid portions of second leg (104) and into wallboard panel (40). In other embodiments, second leg (104) may be attached to wallboard panel (40) via adhesive or any other suitable attachment means.

As shown, bead (103) of finishing accessory (100) comprises first leg (102), second leg (104), lip (106), and removable leg (120). In some embodiments, first leg (102), second leg (104), lip (106), and removable leg (120) may be of unitary construction such that they are formed from a single integral piece of material. In some embodiments, the components of bead (103) may be extruded or coextruded together. However, in other embodiments, one or more of first leg (102), second leg (104), lip (106), and removable leg (120) may comprise non-integral, separate components that are attached to each other. It will thus be appreciated that bead (103) may have a unitary construction or be comprised of various components attached together to collectively form bead (103). In some embodiments, bead (103), including one or more of first leg (102), second leg (104), lip (106), and removable leg (120), may comprise polyvinyl chloride (PVC), steel, aluminum or any other suitable material, including but not limited to other suitable plastics, metals, paper products, and composites. In some embodiments, first leg (102), second leg (104), lip (106), and removable leg (120) may all comprise the same material, while in other embodiments first leg (102), second leg (104), lip (106), and removable leg (120) may comprise two or more different materials.

Finishing accessory (100) may further include components or materials having fire resistant and/or intumescent properties. In some embodiments, at least one portion of bead (103) may comprise material having fire resistant and/or intumescent properties and at least one other portion of bead (103) may comprise material that does not have fire resistant and/or intumescent properties, such that bead (103) includes both fire resistant portions and non-fire resistant portions. In other embodiments, the entire bead (103) may comprise material having fire resistant and/or intumescent properties. By way of example only, in some embodiments at least a portion of bead (103) may comprise material having fire resistant and/or intumescent properties, such as the material described in U.S. Patent Publication No. 2016/0348357 (Smith et al.), published on Dec. 1, 2016, the disclosure of which is incorporated by reference herein. In some embodiments, bead (103) may comprise material that contains graphite, sodium silicates, other additives, or combinations thereof. In some embodiments, bead (103) may comprise a nanocomposite material with fire resistant properties, including but not limited to IntuPlas and/or BernoGraph, which are sold by Pyrophobic Systems Ltd. of Barrie, Ontario, Canada. By way of example only, bead (103) may comprise a material having a composition such as those described in US. Pub. No. 2012/0022201, published Jan. 26, 2012, to Zhvanetskiy et al., the disclosure of which is incorporated herein by reference. Other examples of materials that could be used for bead (103) include but are not limited to: Charmor™, which is sold by Perstorp Holding AB of Malmo, Sweden; Delphi Intumescent Material, which is sold by Delphi Automotive LLC of Gillingham, Kent, United Kingdom; intumescent PVC materials sold by Dugdale Limited of Sowerby Bridge, West Yorkshire, United Kingdom; PVC granules sold by Hangzhou Juntai Plastic Products Co., Ltd. of Hangzhou, Zheijang, China; and FireCarb, which is sold by LKAB Minerals AB of Lulea, Sweden.

In the embodiment shown in FIG. 2, removable leg (120) extends from the vertical leg (106*a*) of lip (106) along the longitudinal length of first leg (102). In other embodiments, including those where lip (106) is omitted, removable leg (120) may extend from either first leg (102) or second leg (104) at any suitable location, length, and/or orientation. In some embodiments, removable leg (120) may be integrally attached to first leg (102), second leg (104), or lip (106) via extrusion of bead (103) during the manufacturing process. In the illustrated embodiment, removable leg (120) of finishing accessory (100) is configured to inhibit any finishing material, such as joint compound, veneer plaster, paint, or other similar materials applied to second leg (104) from being inadvertently applied to the surrounding components of finishing accessory (100) or wall assembly (10), such as strip (110) and lower surface (51) of horizontal support structure (50).

As shown, bead (103) further includes a frangible connection (107) extending between lip (106) and removable leg (120). More particularly, frangible connection (107) may have a thin and/or weakened section of material configured to selectively fracture upon being manipulated by a user. A user may thus separate removable leg (120) from lip (106) by grasping removable leg (120) at any location along the longitudinal length of removable leg (120) (e.g., a proximal end, a distal end, a middle portion, and/or etc.) and applying sufficient force to removable leg (120) in a direction generally away from lip (106) (e.g., an upward force, a downward force, a rightward force, or an angled force generally away from lip (106)). As used herein, the term "fracture" generally refers to the failure of the material itself such that the material may crack, rip, and/or tear for separation of removable leg (120) from bead (103). The term "fracture" is not intended to unnecessarily limit the invention described herein. In instances where lip (106) is omitted from bead (103), frangible connection (107) may be positioned along removable leg (120) such that the portion of removable leg (120) connecting to first leg (102) and/or second leg (104) has a thin and/or weakened material configured to selectively fracture in response to application of sufficient force.

In some embodiments, removable leg (120) may include one or more apertures and/or perforations along frangible connection (107) between removable leg (120) and lip (106) to further weaken frangible connection (107). In these embodiments, the apertures and/or perforations along frangible connection (107) are configured to facilitate removal of removable leg (120). It will be appreciated that such apertures and/or perforations are not required, but may be desirable to ease removal of removable leg (120) depending on the material(s) from which bead (103) may be manufactured. The apertures and/or perforations may be sized and shaped to enhance the ease in removing removable leg (120) while still inhibiting a finishing material that is applied to second leg (104) from contacting any surrounding components of finishing accessory (100) or wall assembly (10), as described above.

Removable leg (120) may be configured to be gripped directly by hand by the user for removal from lip (106). However, the user may alternatively grip removable leg (120) indirectly with a tool, including but not limited to, a pair of pliers or other suitable gripping devices, to manipulate removable leg (120) relative to lip (106). In this instance, applying a necessary force to removable leg (120) via the tool is operable to fracture frangible connection (107) and thereby separate removable leg (120) from lip (106). Other methods and/or tools for separating removable leg (120) from lip (106) may also be used. By way of example only, removable leg (120) may be removed from lip (106) by cutting removable leg (120) along frangible connection (107) with a knife, scissors, boxcutter, and/or other various suitable cutting means. While removable leg (120) is removably connected to lip (106) via frangible connection (107) in the illustrated embodiment, other embodiments of finishing accessory (100) may include alternative connections between removable leg (120) and lip (106). As merely an illustrative example, an adhesive connection or mechanical connection may be employed to removably connecting removable leg (120) to lip (106) of bead (103).

In the embodiment shown in FIGS. 1 and 2, finishing accessory (100) includes strip (110), which is a separate component attached to the exterior surface (102*a*) of first leg (102). In this embodiment, strip (110) is only located on first leg (102) and does not extend onto second leg (104). As shown, strip (110) comprises a substantially rectangular cross-section. In other embodiments strip (110) may comprise various other suitable cross-sections. By way of example only, strip (110) may comprise a squared, circular, or other suitable cross-section. In some embodiments, strip (110) may comprise a rectangular cross-section that is oriented such that the height (i.e., vertical dimension) of strip (110) is greater than the width (i.e., horizontal dimension) of strip (110). Strip (110) may be attached to first leg (102) using an adhesive, one or more fasteners, or any other attachment means as will be apparent to those of ordinary skill in the art. In some embodiments where strip (110) is attached to first leg (102) with a layer of adhesive, the adhesive may be fire resistant or, in other words, able to maintain its adhesive qualities at elevated temperatures by incorporating fire resistant properties. In some embodiments strip (110) may be attached to first leg (102) as a result of strip (110) and first leg (102) being coextruded together.

As shown in FIGS. 1 and 2, strip (110) comprises a base layer (112) and a fire resistant layer (114). Base layer (112) may comprise a resilient and/or compressible material, such as a closed cell foam or an open cell foam. In some embodiments, base layer (112) may comprise a material used for conventional backer rod or another substantially similar material. In the illustrated embodiment, fire resistant layer (114) is attached atop base layer (112) such that fire resistant layer (114) is positioned above base layer (112) and between horizontal support structure (50) and bead (103) in wall assembly (10). Fire resistant layer (114) may comprise material that has fire resistant properties.

In some embodiments, fire resistant layer (114) may comprise material that has intumescent properties that allow the material to expand and, in some embodiments char, in response to being subjected to elevated temperatures in order to resist fire. By way of example only, the fire resistant material may be configured to expand when it is exposed to temperatures at or above about 300 degrees Fahrenheit. In other examples, the fire resistant material may fully intumesce when exposed to temperatures at or above about 375 degrees Fahrenheit. This may help provide fire protection at the head of wall joint between wallboard panel (40) and horizontal support structure (50) where finishing accessory (100) is installed.

Fire resistant layer (114) may also comprise a resilient and/or compressible material similar to base layer (112). In some embodiments, fire resistant layer (114) may comprise intumescent tape, while in other embodiments fire resistant layer (114) may comprise an intumescent coating applied to the upper surface of base layer (112). In some embodiments, fire resistant layer (114) is substantially the same width and length as base layer (112) such that substantially the entire upper surface of base layer (112) is covered by fire resistant layer (114). In other embodiments, fire resistant layer (114) may cover less than the entire upper surface of base layer (112) provided fire resistant layer (114) comprises a sufficient amount of fire resistant material to allow finishing accessory (100) to provide the desired fire resistant properties.

Fire resistant layer (114) may be attached to base layer (112) using any conventional means or methods, including but not limited to an adhesive between fire resistant layer (114) and base layer (112). In embodiments that use an adhesive, the adhesive may be fire resistant or, in other words, able to maintain its adhesive qualities at elevated temperatures. By way of example only, in one embodiment, fire resistant layer (114) may comprise intumescent tape with an adhesive on the bottom surface. Accordingly, in such an embodiment, when fire resistant layer (114) is placed on top of base layer (112), the two layers (112, 114) are attached to each other with the adhesive.

Figure 3:
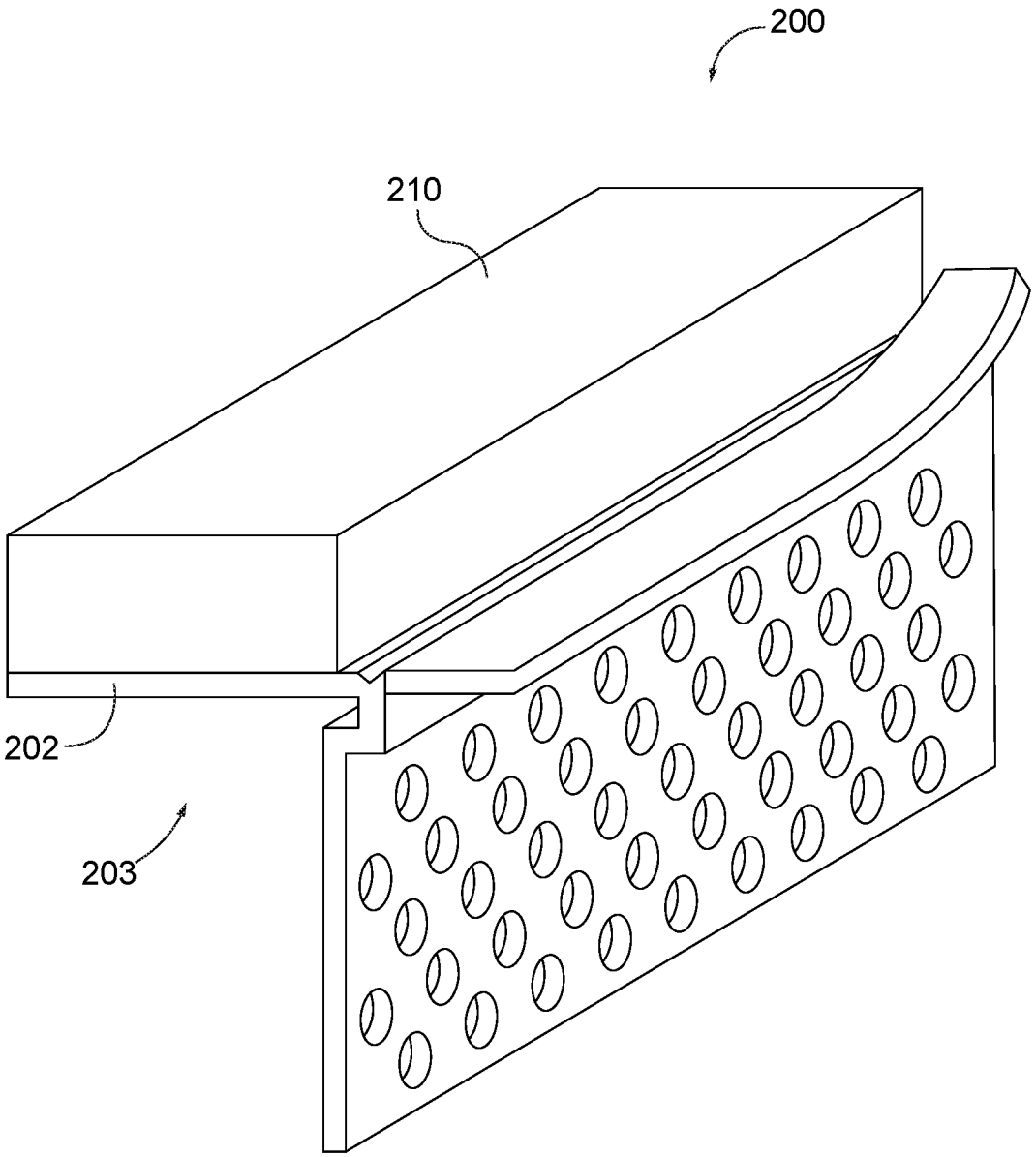
FIG. 3 depicts a top perspective view of an alternate exemplary finishing accessory.

FIG. 3 depicts an exemplary alternative finishing accessory (200) that is similar to finishing accessory (100), except that strip (210) is different from strip (110) described above. Bead (203) may be constructed similarly and may be made out of similar materials as bead (103) described above. Accordingly, the portions of finishing accessory (200) that are identical to those in finishing accessory (100) will not be described again. Unlike strip (110) described above that comprises a base layer (112) and a fire resistant layer (114), strip (210) comprises a single layer of material with fire resistant properties as similarly described above. Strip (210) may also comprise material that is resilient and/or compressible, such as closed cell foam or open cell foam. In some embodiments, strip (210) may comprise a material used for conventional backer rod or another substantially similar material.

In some embodiments, strip (210) may comprise material that also has intumescent properties. By way of example only, strip (210) may comprise a conventional backer rod material (e.g., closed cell foam, open cell foam, etc.) with fire resistant and intumescent properties. In the illustrated embodiment, strip (210) is a separate component attached to first leg (202) of finishing accessory (200). Strip (210) may be attached to first leg (202) using an adhesive, one or more conventional fasteners, or any other suitable attachment methods. In embodiments that use a layer of adhesive to attach strip (210) to first leg (202), the adhesive may be fire resistant or, in other words, able to maintain its adhesive qualities at elevated temperatures.

Figure 4:
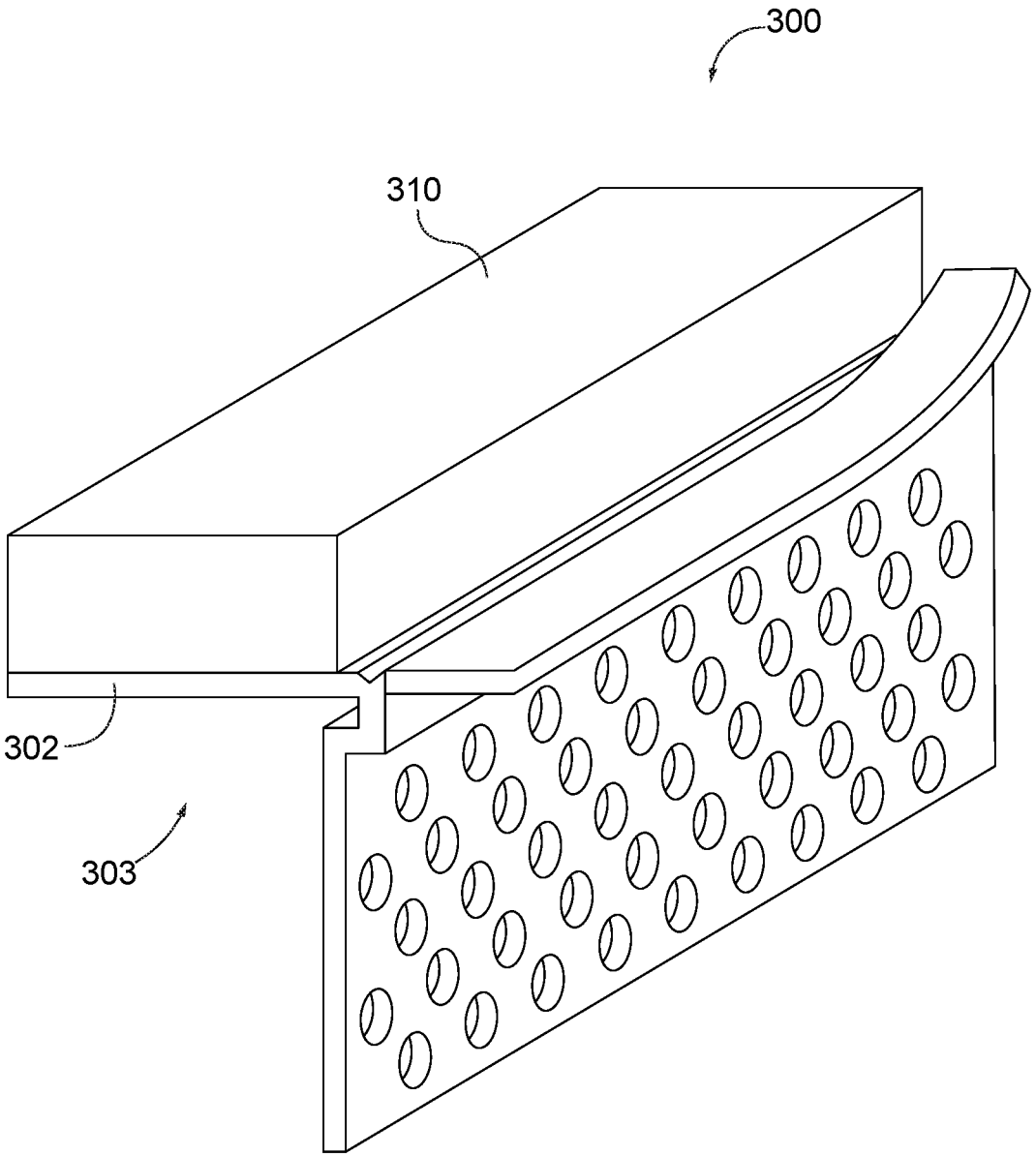
FIG. 4 depicts a top perspective view of another alternate exemplary finishing accessory.

FIG. 4 depicts another exemplary alternative finishing accessory (300) that is similar to finishing accessories (100, 200), except that strip (310) is different from strips (110, 210) described above. Bead (303) may be constructed similarly and may be made out of similar materials as beads (103, 203) described above. Accordingly, the portions of finishing accessory (300) that are identical to those in finishing accessories (100, 200) will not be described again. Unlike strip (110) described above that comprises a base layer (112) and a fire resistant layer (114), in the illustrated embodiment strip (310) comprises a single layer of material. In some embodiments strip (310) may comprise material with sound insulating properties. In other words, strip (310) may comprises material that is configured to inhibit sound from traveling through strip (310). For example, strip (310) may comprise a material that has a density sufficient to allow the inclusion of finishing accessory (300) in the wall assembly to increase the sound transmission class (STC) rating of the wall assembly.

In some embodiments, strip (310) may comprise material that is resilient and/or compressible, such as closed cell foam or open cell foam, that may or may not have sound insulating properties. One example of a material with sound insulating properties that could be used for strip (310) is a sound insulating gasket, including but not limited to a product sold under the name "ArmaSeal" by Armacell LLC of Mebane, N.C. Of course, strip (310) is not required to comprise ArmaSeal as other suitable materials that provide the desired sound insulating properties may also be used. In some embodiments, strip (310) may comprise a material used for conventional backer rod or another similar material. In some embodiments, strip (310) may comprise material that also has fire resistant and/or intumescent properties in addition to sound insulation properties, while in other embodiments, strip (310) may comprise material that has sound insulation properties but does not have fire resistant and/or intumescent properties. By way of example only, strip (310) may comprise a conventional backer rod material (e.g., closed cell foam) with sound insulating properties. In still other embodiments, strip (310) may comprise material that does not have fire resistant and/or intumescent properties or sound insulation properties.

In the illustrated embodiment, strip (310) is a separate component attached to first leg (302) of finishing accessory (300). Strip (310) may be attached to first leg (302) using an adhesive, one or more conventional fasteners, or any other suitable attachment methods. In embodiments that use an adhesive layer to attach strip (310) to first leg (302), the adhesive may be fire resistant or, in other words, able to maintain its adhesive qualities at elevated temperatures as described in greater detail above.

Figure 5:
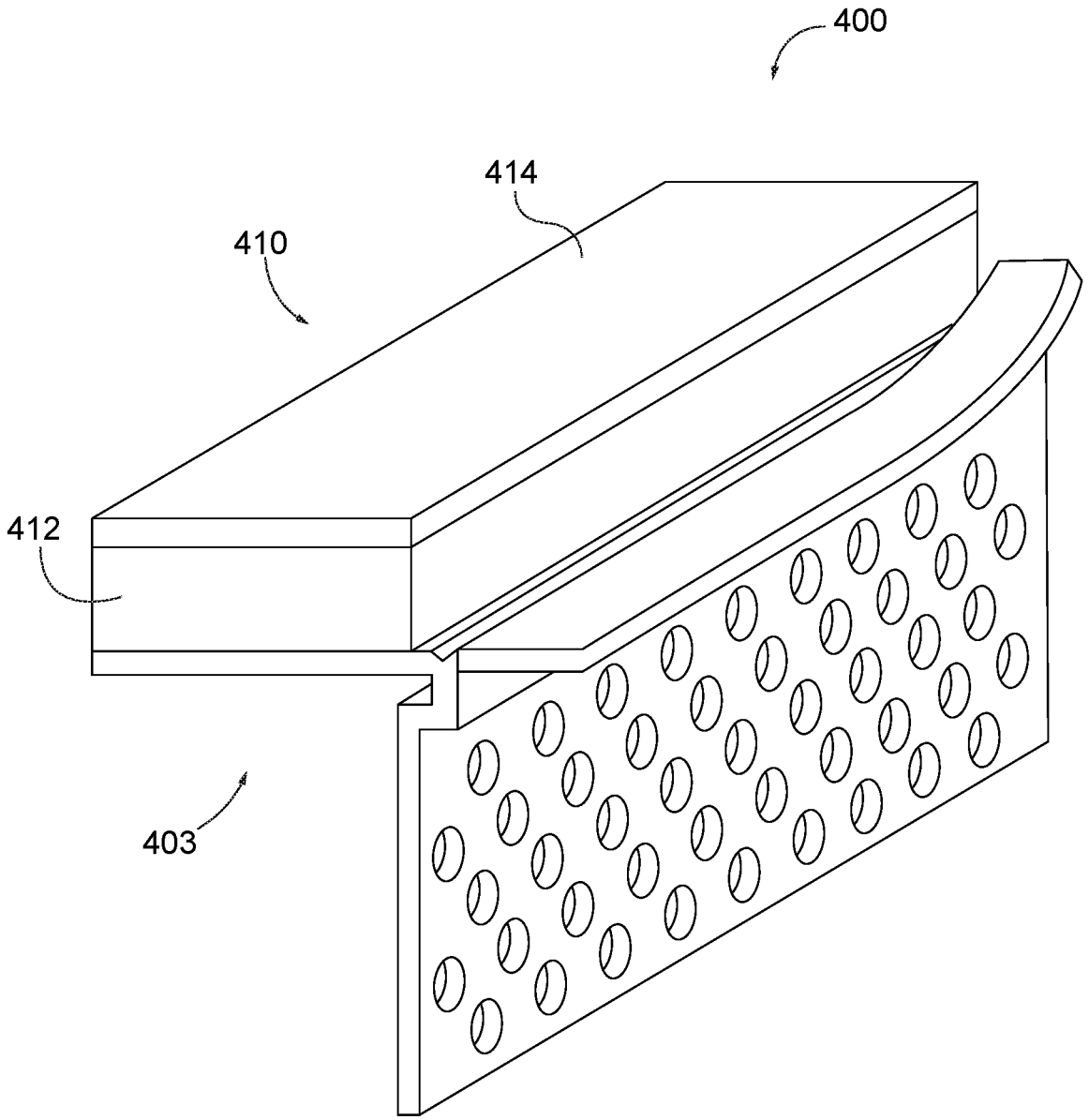
FIG. 5 depicts a top perspective view of another alternate exemplary finishing accessory.

FIG. 5 depicts another exemplary alternative finishing accessory (400). Finishing accessory (400) is similar to finishing accessory (300), except that finishing accessory (400) includes a strip (410) that comprises an adhesive layer (414) on the top surface of a base layer (412). Bead (403) may be constructed similarly and may be made out of similar materials as beads (103, 203, 303) described above. Base layer (412) is identical to strip (310) described above. Accordingly, the portions of finishing accessory (400) that are identical to those in finishing accessories (100, 200, 300) will not be described again. Adhesive layer (414) may comprise adhesive on the upper surface of adhesive layer (414) so that strip (410), and, as a result, finishing accessory (400), can be attached to the adjacent horizontal support structure (50). Adhesive layer (414) may comprise a piece of tape with adhesive on both the top and bottom surfaces of the tape, an adhesive coating, or any other material suitable to engage both underlying base layer (412) and an adjacent horizontal support structure (50) of wall assembly (10). In some embodiments, adhesive layer (414) may also comprise a resilient and/or compressible material. It should be noted that in some embodiments, an adhesive layer, such as adhesive layer (414), may be incorporated into finishing accessories (100, 200) described above as well. In that instance, adhesive layer (414) may be attached to the upper surface of fire resistant layer (114) or the upper surface of strip (210), respectively.

Adhesive layer (414) is substantially the same width and length as base layer (412) such that a substantial portion of the upper surface of base layer (412) is covered by adhesive layer (414). In other embodiments, adhesive layer (414) may cover less than the entire upper surface of base layer (412) provided that adhesive layer (414) comprises a sufficient amount of adhesive to adequately adhere base layer (412) and finishing accessory (400) to the adjacent horizontal support structure (50). Adhesive layer (414) may be fire resistant or, in other words, able to maintain its adhesive qualities at elevated temperatures as described in greater detail above.

In the wall assembly (10) illustrated in FIG. 1, finishing accessory (100) is installed on top of wallboard panel (40) such that strip (110) is positioned within gap (60) between top edge (42) of wallboard panel (40) and the lower surface (51) of horizontal support structure (50). As shown, first leg (102) is positioned along top edge (42) of wallboard panel (40) and second leg (104) extends downwardly from lip (106) and contacts outer vertical surface (44) of wallboard panel (40). In some embodiments, first leg (102) may be attached to wallboard panel (40) with adhesive between interior surface (102*b*) of first leg (102) and top edge (42), one or more fasteners securing first leg (102) to top edge (42), or any other suitable attachment means. Strip (110) may be dimensioned such that upper surface (116) of strip (110) contacts the lower surface (51) of horizontal support structure (50). In some embodiments, depending on the contour of lower surface (51) (e.g., if there are irregularities or a rough finish on a concrete slab, if horizontal support structure (50) comprises a fluted deck, etc.), some portions of upper surface (116) of strip (110) may contact lower surface (51) of horizontal structure (50) while other portions of upper surface (116) of strip (110) may not. In embodiments where the upper surface (116) of strip (110) contacts the lower surface (51) of horizontal support structure (50), that contact may provide a seal that helps prevent the spread of smoke at the head of wall joint and reduces the amount of sound that passes through the head of wall joint, even when strip (110) is in a normal or unexpanded state. In embodiments where strip (110) comprises material with intumescent properties, at least a portion of strip (110) may be configured to expand when exposed to elevated temperatures, thereby expanding into surrounding gaps and substantially sealing the head of wall joint to help prevent the spread of smoke and fire through the joint.

In embodiments where strip (110) comprises compressible material, such a construction allows wallboard panel (40) to travel vertically during deflections because strip (110) can be compressed as wallboard panel (40) travels upward toward horizontal supporting structure (50). In embodiments where strip (110) comprises material that is also resilient, strip (110) can then return to its original size to substantially fill gap (60) as wallboard panel (40) travels downward away from horizontal supporting structure (50). This may help prevent cracking of wallboard panel (40) and surrounding materials during deflections.

As shown in FIG. 1, gap (60) is substantially filled by first leg (102) of finishing accessory (100) and strip (110) in both the vertical and horizontal dimensions (i.e., height and width, respectively) of gap (60). In other words, the width of first leg (102) and strip (110) are substantially equal to the width of gap (60). In other embodiments first leg (102) and/or strip (110) may comprise a width that is less than the width of gap (60) which may result in the interior side surface (113) of strip (110) being horizontally spaced apart from the leg or flange (24) of header track (20). In other embodiments, such as the embodiment shown in FIG. 6, the first leg may be wider than the strip such that the free end of the first leg extends laterally beyond the interior side surface of the strip. In other embodiments, such as the embodiments shown in FIGS. 7-38, the strip may be wider than the first leg such that at least a portion of the strip extends laterally beyond the free end of the first leg. In some embodiments, regardless of the width of the strip relative to the width of the first leg, the strip may be positioned along the first leg such that the interior side surface is positioned laterally beyond the free end of the first leg. Having the interior side surface of the strip positioned laterally beyond the free end of the first leg may help keep the free end of the first leg spaced apart from flange (24) of header track (20), which may help the finishing accessory remain within gap (60) as wallboard panel (40) vertically deflects. Similarly, in some embodiments, the width of the first leg may be less than the width of wallboard panel (40), which may also result in the free end of the first leg being spaced apart from flange (24) of header track (20).

In some embodiments, at least about 50% of the exterior surface (102*a*) of first leg (102) is covered by strip (110). In other embodiments, at least about 75% of the exterior surface (102*a*) of first leg (102) is covered by strip (110), and in still other embodiments, including but not limited to the embodiment shown in FIG. 2, substantially all of the exterior surface (102*a*) of first leg (102) is covered by strip (110). Having strip (110) cover at least about 50% of the exterior surface (102*a*) of first leg (102) may help fill in gap (60). In the embodiment illustrated in FIGS. 1 and 2, strip (110) is positioned along first leg (102) such that the outer side surface (115) is positioned adjacent to leg (106) and the fixed end of first leg (102). Positioning strip (110) such that the outer side surface (115) is positioned adjacent to leg (106) and the fixed end of first leg (102) may make it easier to create a smooth, finished appearance by applying a layer of finishing material and/or a finishing component to conceal strip (110).

As shown in FIG. 1, the combined height of first leg (102) and strip (110) is substantially equal to the height of gap (60) such that the upper surface (116) of strip (110) contacts the lower surface (51) of horizontal support structure (50). In other embodiments, the combined height of first leg (102) and strip (110) may be greater than the height of gap (60). In this instance, finishing accessory may still be installed as shown as strip (110) may be compressed to fit within gap (60). By way of example only, both gap (60) and the combined height of strip (110) and first leg (102) may be approximately ⅜ inches. It should be understood that gap (60) and the combined height of strip (110) and first leg (102) may be other suitable sizes depending on the particular application.

The thickness, or height, of first leg (102) may vary depending on what material first leg (102) is made out of. By way of example only, in some embodiments where first leg (102) comprises a plastic, first leg (102) may have thickness or height of approximately 0.028 inches. In other embodiments where first leg (102) comprises a metal, first leg (102) may have a thickness or height of approximately 0.010 inches. Strip (110) may comprise any thickness, or height, suitable to provide the desired combined height of strip (110) and first leg (102).

Finishing accessory (100) may be installed by placing first leg (102) on wallboard panel (40) such that first leg (102) contacts and rests on top edge (42) of wallboard panel (40), while second leg (104) is in contact with outer vertical surface (44) of wallboard panel (40). As described above, finishing accessory (100) is preferably positioned such that upper surface (116) of strip (110) is in contact with the lower surface (51) of horizontal support structure (50). In some embodiments, second leg (104) may be attached to outer surface (44) of wallboard panel (40) by inserting one or more fasteners through second leg (104) and into wallboard panel (40), although this is not required. Once finishing accessory (100) is in the desired position, a layer of finishing material, such as joint compound, veneer plaster, paint, or other similar materials, may be applied over second leg (104) and a portion of outer surface (44) of wallboard panel (40) to produce a flush finish. In embodiments that include a removable leg (120), the removable leg (120) may be separated from bead (103) and removed once the desired amount of finishing material has been applied to second leg (104) and wallboard panel (40). In some embodiments, wall assembly (10) may be finished by installing one or more finishing components, such as joint tape and joint compound, at the top of wall assembly (10) to cover strip (110). In those embodiments, the joint compound may be applied such that it contacts at least a portion of the outer surface of strip (110). In other embodiments, the finishing component may be omitted and strip (110) may be left exposed.

Figure 6:
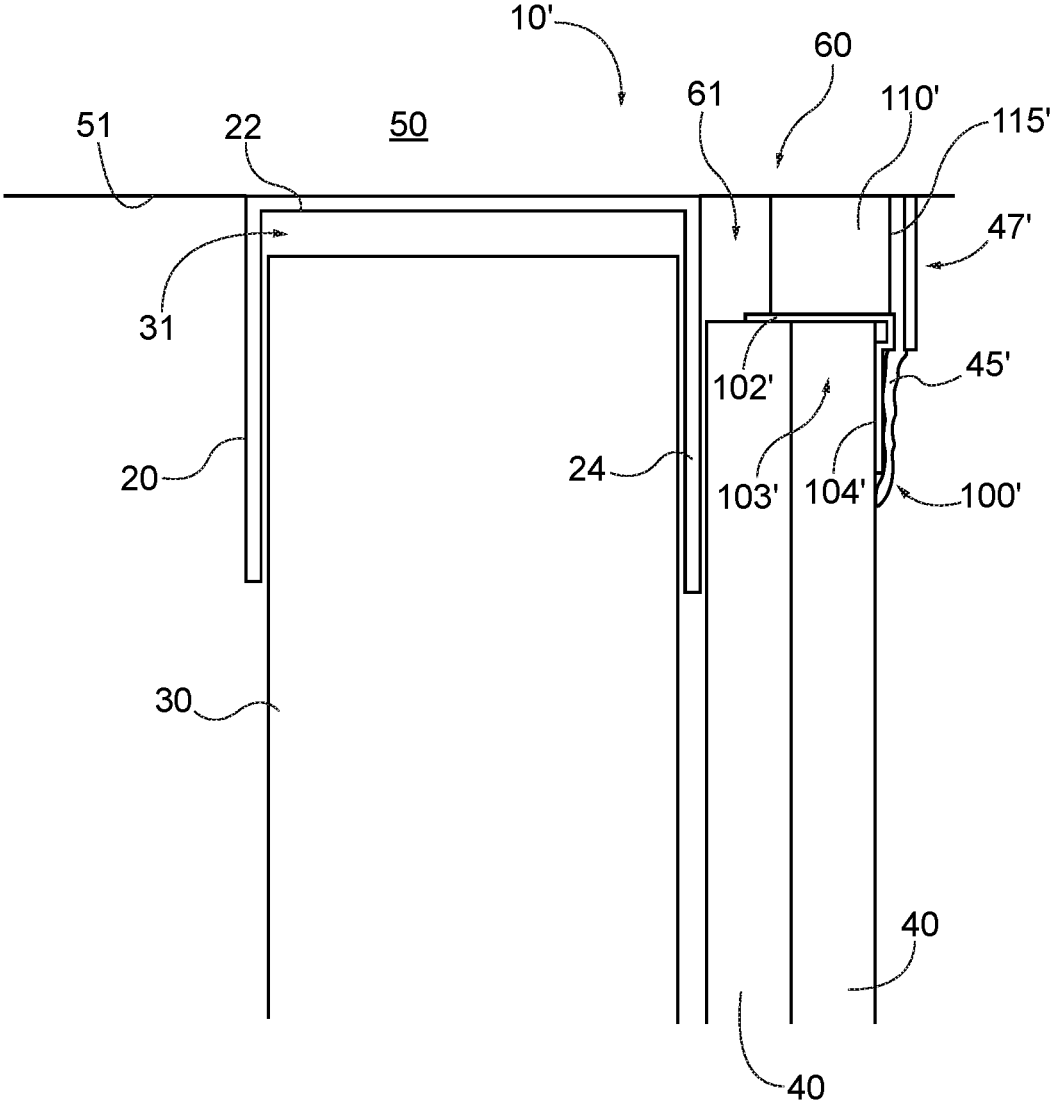
FIG. 6 depicts a front view of an alternate exemplary wall assembly that includes another alternate exemplary finishing accessory.
Figure 7:
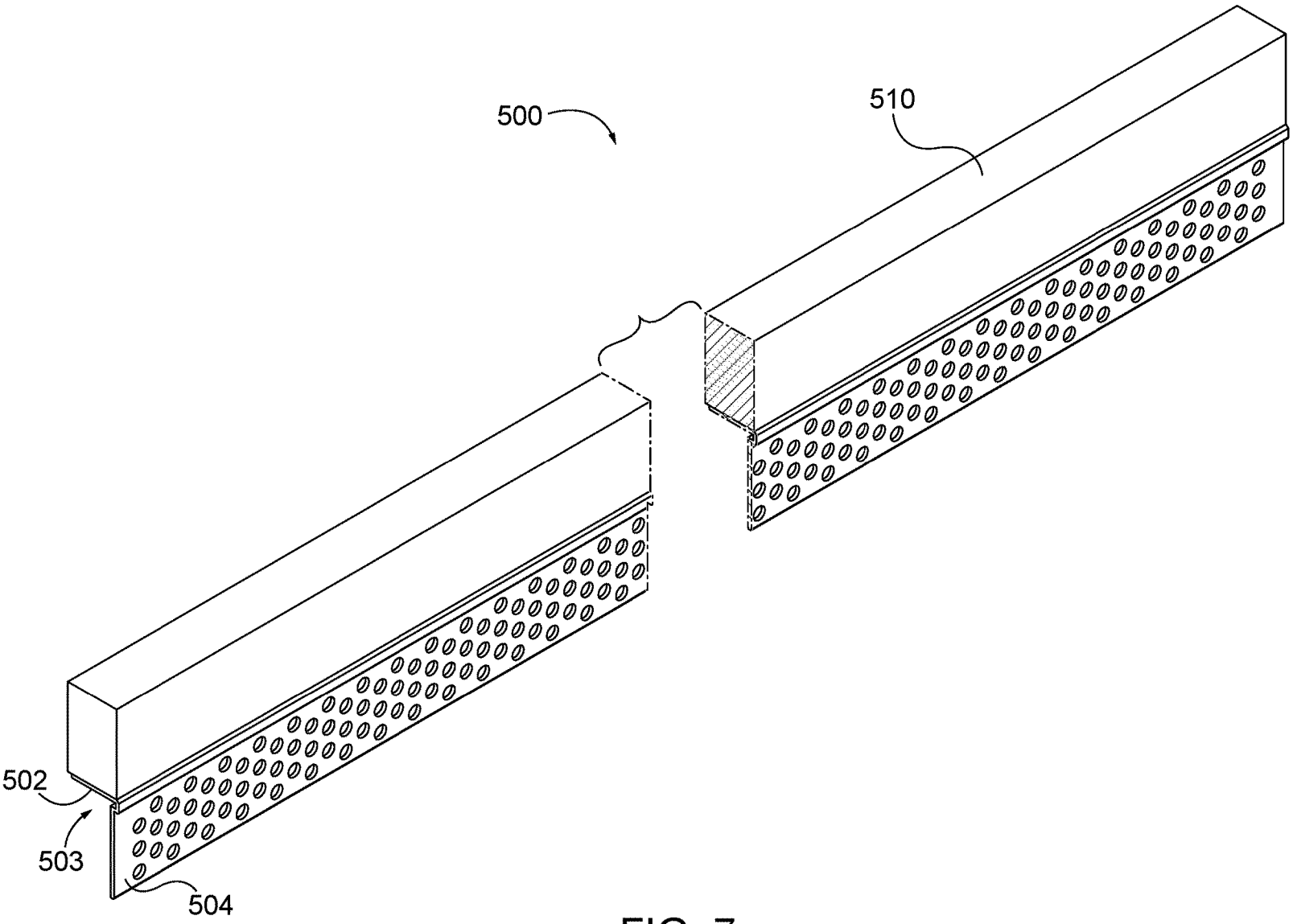
FIG. 7 depicts a top perspective view of another alternate exemplary finishing accessory.
Figure 8:
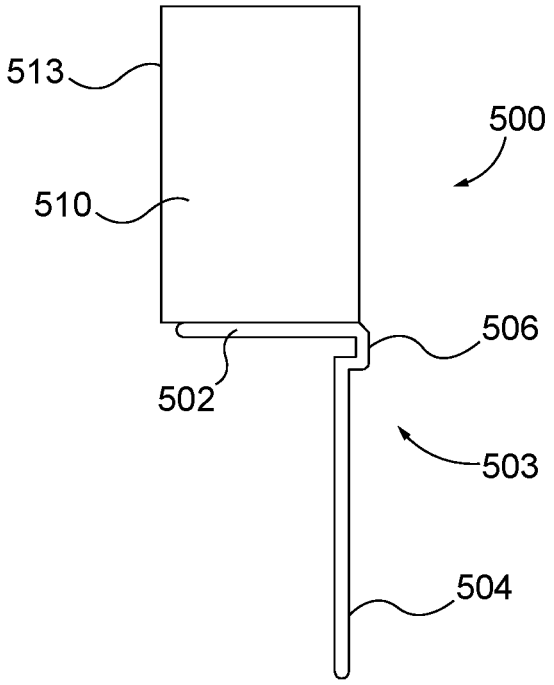
FIG. 8 depicts a front elevational view of the finishing accessory of FIG. 7.
Figure 9:
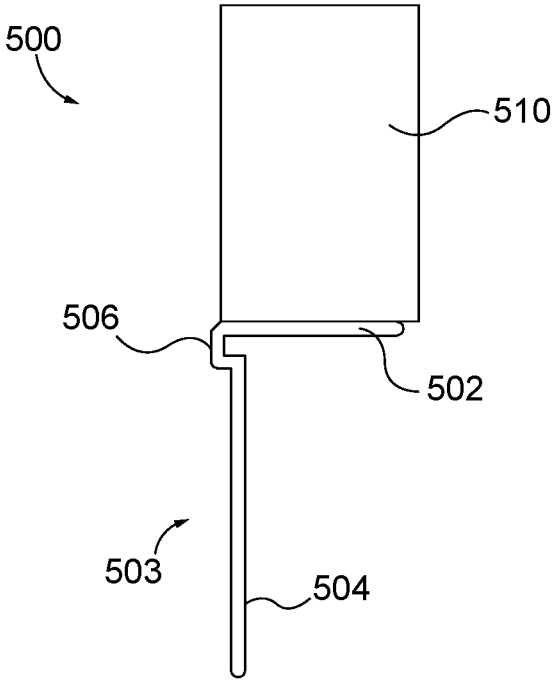
FIG. 9 depicts a rear elevational view of the finishing accessory of FIG. 7.
Figure 10:
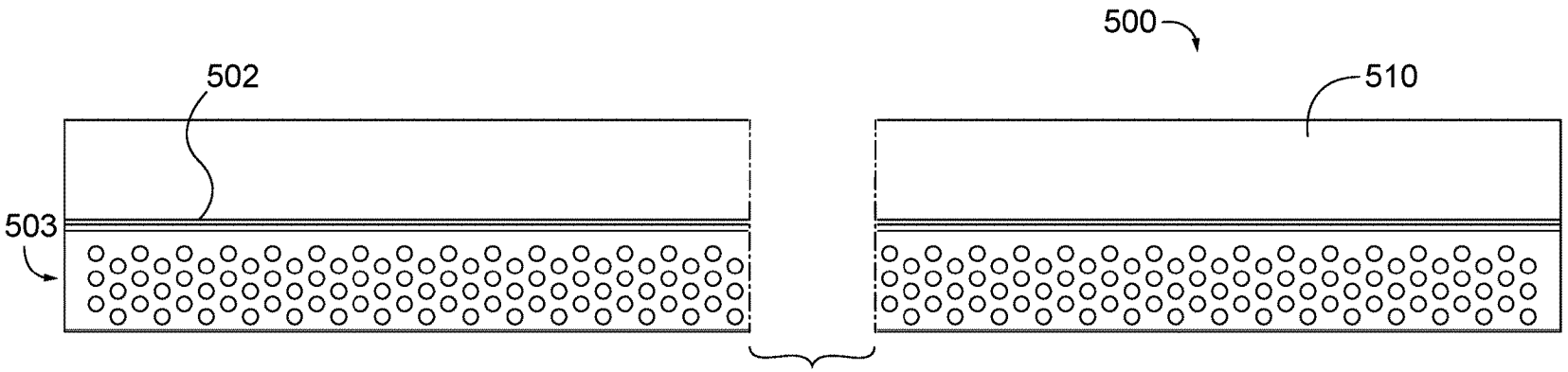
FIG. 10 depicts a left side elevational view of the finishing accessory of FIG. 7.
Figure 11:
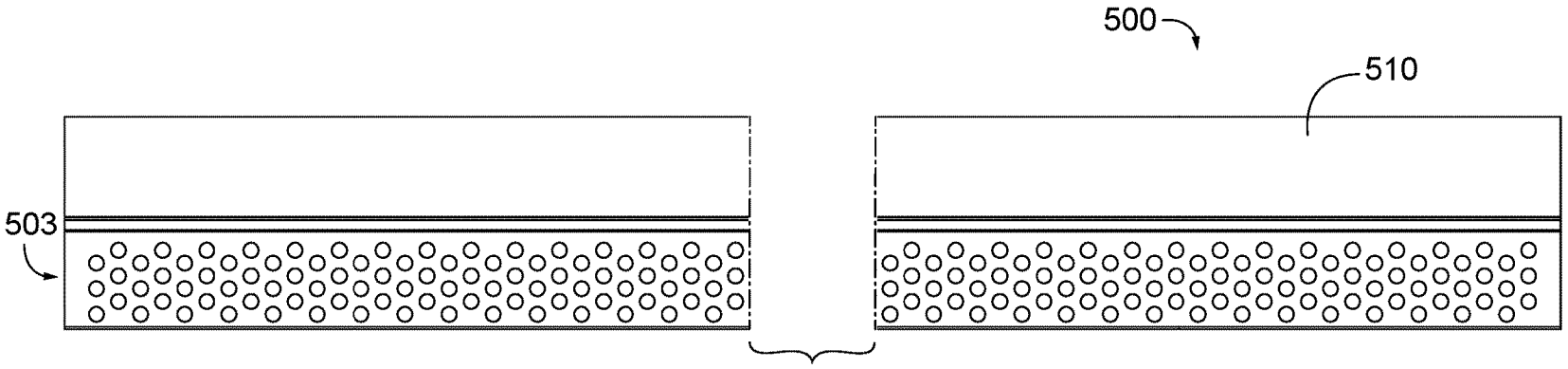
FIG. 11 depicts a right side elevational view of the finishing accessory of FIG. 7.
Figure 12:
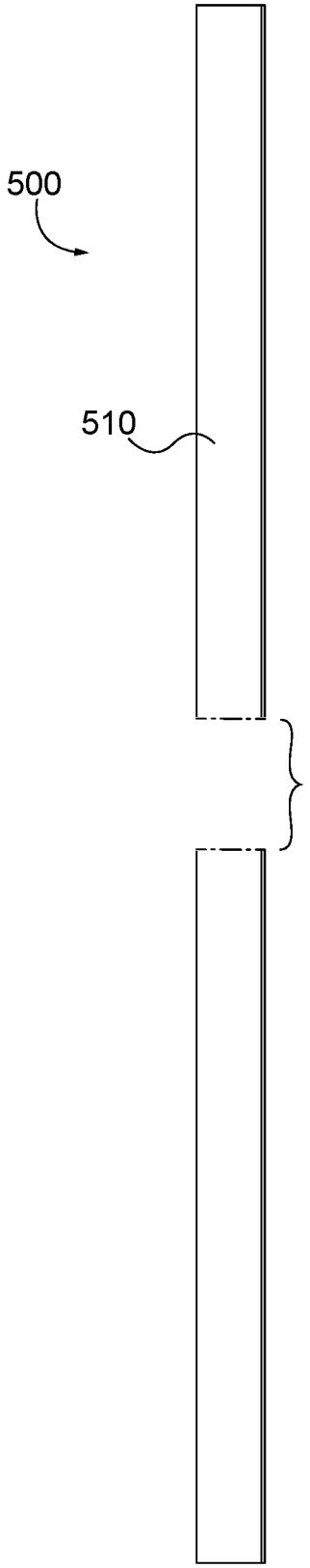
FIG. 12 depicts a top plan view of the finishing accessory of FIG. 7.
Figure 13:
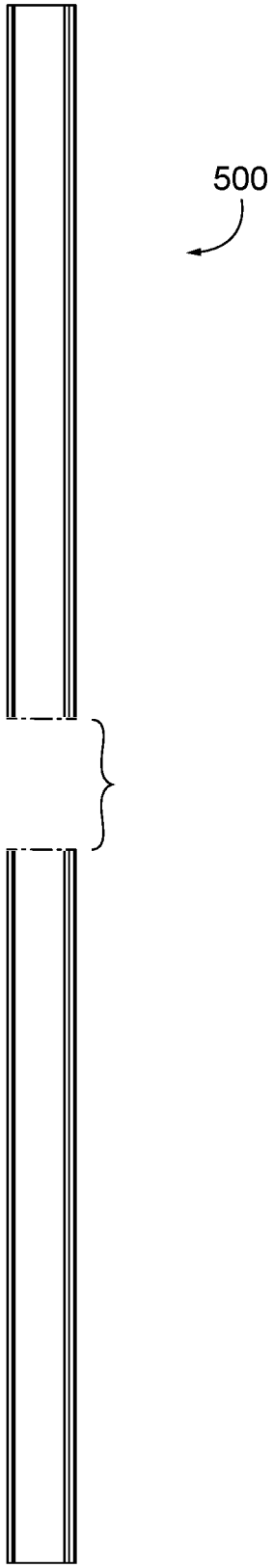
FIG. 13 depicts a bottom plan view of the finishing accessory of FIG. 7.

FIG. 6 depicts an alternate wall assembly (10') that is substantially similar to wall assembly (10) shown in FIG. 1 and described above with a few differences. Accordingly, the portions of wall assembly (10') that are identical to those in wall assembly (10) are labeled with the same item numbers as above and will not be described again. As shown in FIG. 6, wall assembly (10') includes two wallboard panels (40) and alternate embodiment of a finishing accessory (100'). Finishing accessory (100') is similar to finishing accessory (100), except that in the illustrated embodiment first leg (102') of finishing accessory (100') extends beyond the interior side surface of strip (110'). In other words, the width of strip (110') is less than the width of first leg (102'). In addition, in wall assembly (10'), strip (110') is positioned within gap (60) between the top edges of the wallboard panels, however the width of strip (110') is less than the width of gap (60). As a result, the interior side surface of strip (110') is spaced apart from the outer surface of the leg or flange (24) of header track (20), which creates a gap (61) between the leg or flange (24) of header track (20) and strip (110'). Similar to strip (110) described above, in some embodiments, strip (110') may be dimensioned such that the upper surface of strip (110') contacts the lower surface (51) of horizontal support structure (50) when finishing accessory (100') is installed in wall assembly (10'). In addition, wall assembly (10') depicted in FIG. 6 includes finishing material (45') applied over second leg (104') and a finishing component (47') positioned over strip (110'). In some embodiments, finishing component (47') may comprise joint tape and joint compound. In some of those embodiments, the joint compound and joint tape may be applied such that at least one of the joint tape and joint compound contacts at least a portion of the outer side surface (115') of strip (110'). Although strip (110') is shown as comprising one layer of material, similar to strips (210, 310) described above, in other embodiments strip (110') may comprise two or more layers of material, similar to strips (110, 410) described above. In addition, strip (110') may comprise material having any of the properties (e.g., fire resistant, intumescent, sound insulating, compressible and/or resilient, etc.) described above with regard to strips (110, 210, 310, 410).

FIGS. 7-14 depict another exemplary alternative finishing accessory (500). Finishing accessory (500) is shown in FIGS. 7-13 with a symbolic break to indicate that it could be any length, similar to finishing accessory (100) described above. As shown, finishing accessory (500) is similar to finishing accessories (100, 200, 300, 400) described above, except that bead (503) does not include a removable leg and strip (510) comprises a different cross-section and relative width compared to strips (110, 210, 310, 410) described above. Accordingly, the portions of finishing accessory (500) that are identical to those in finishing accessories (100, 200, 300, 400) will not be described again. Unlike strips (110, 210, 310, 410) described above that comprise a rectangular cross-section where the width of strips (110, 210, 310, 410) is greater than the height of strips (110, 210, 310, 410), in the illustrated embodiment, strip (510) comprises a rectangular cross-section where the height of strip (510) is greater than the width of strip (510). In addition, in the embodiment shown in FIGS. 7-14, strip (510) is positioned on first leg (502), such that strip (510) extends laterally away from the fixed end of second leg (502) beyond the free end of first leg (502).

In the illustrated embodiment, strip (510) is a separate component attached to first leg (502) of finishing accessory (500). Strip (510) may be attached to first leg (502) using an adhesive, one or more conventional fasteners, or any other suitable attachment methods. In embodiments that use a layer of adhesive to attach strip (510) to first leg (502), the adhesive may be fire resistant or, in other words, able to maintain its adhesive qualities at elevated temperatures. Although strip (510) is shown as comprising one layer of material, similar to strips (210, 310) described above, in other embodiments strip (510) may comprise two or more layers of material, similar to strips (110, 410) described above. In addition, strip (510) may comprise material similar to the material for strips (110, 210, 310, 410) described above (e.g., closed cell foam, open cell foam, etc.) and that material may have any of the properties (e.g., fire resistant, intumescent, sound insulating, compressible and/or resilient, etc.) described above with regard to strips (110, 210, 310, 410). Similarly, bead (503) may be constructed similarly and may be made out of similar materials as beads (103, 203, 303, 403) described above.

Figure 14:
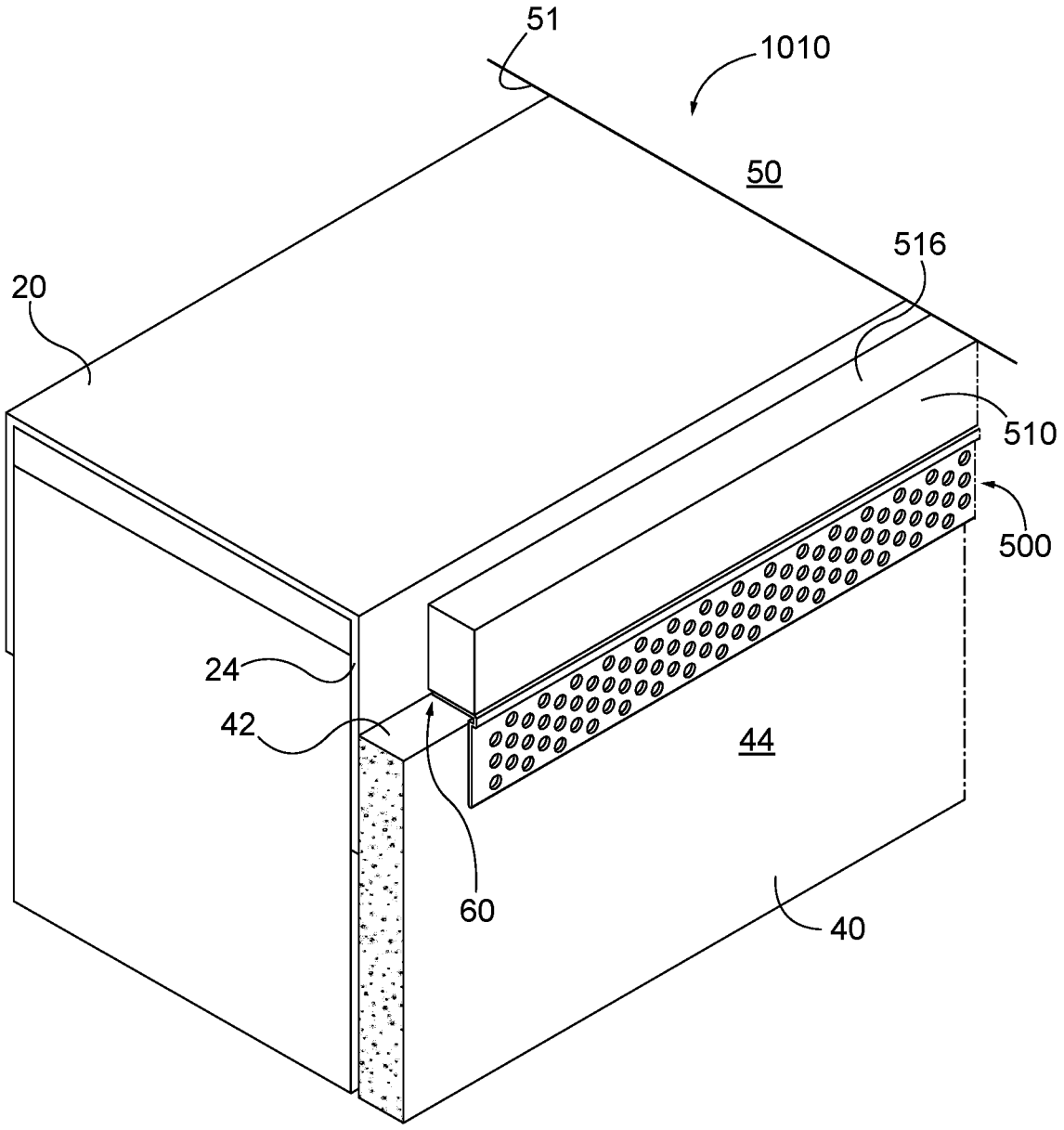
FIG. 14 depicts a partial perspective view of an alternate exemplary wall assembly that includes the finishing accessory of FIG. 7.
Figure 15:
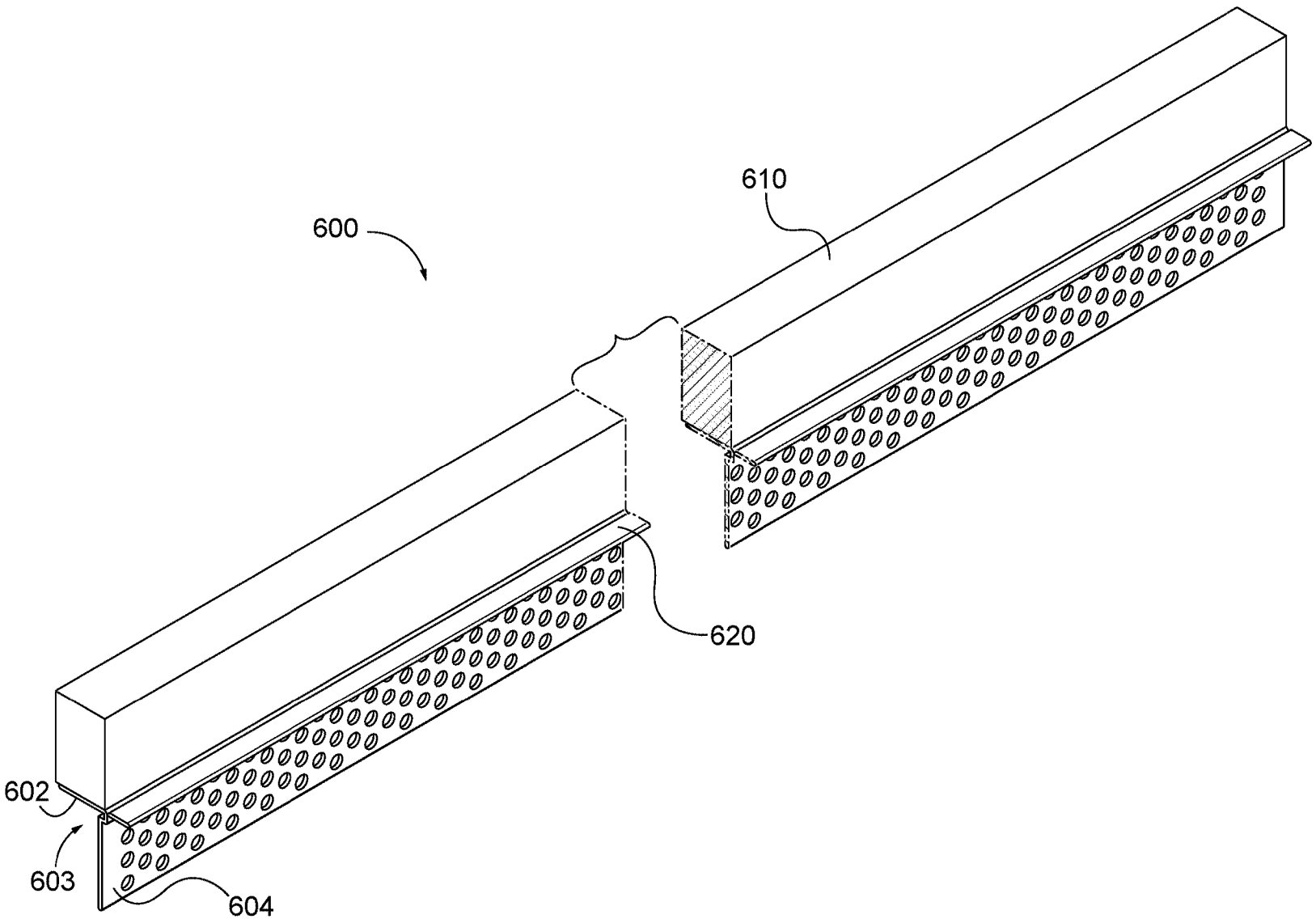
FIG. 15 depicts a top perspective view of another alternate exemplary finishing accessory.
Figure 16:
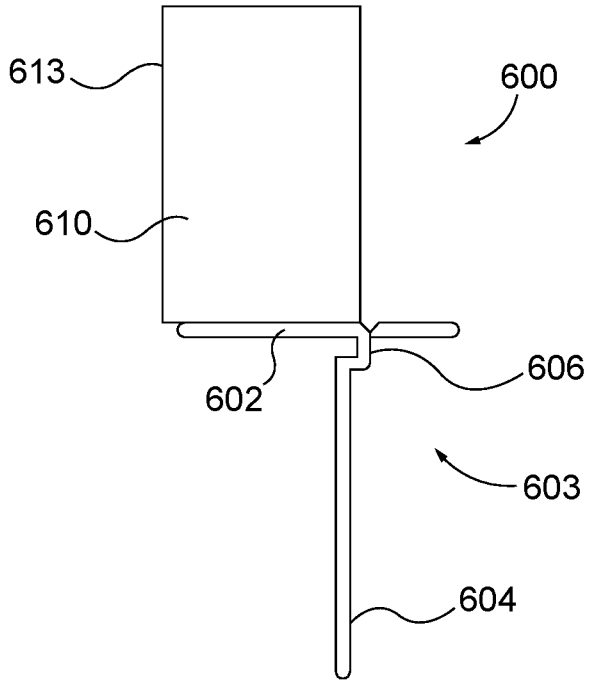
FIG. 16 depicts a front elevational view of the finishing accessory of FIG. 15.
Figure 17:
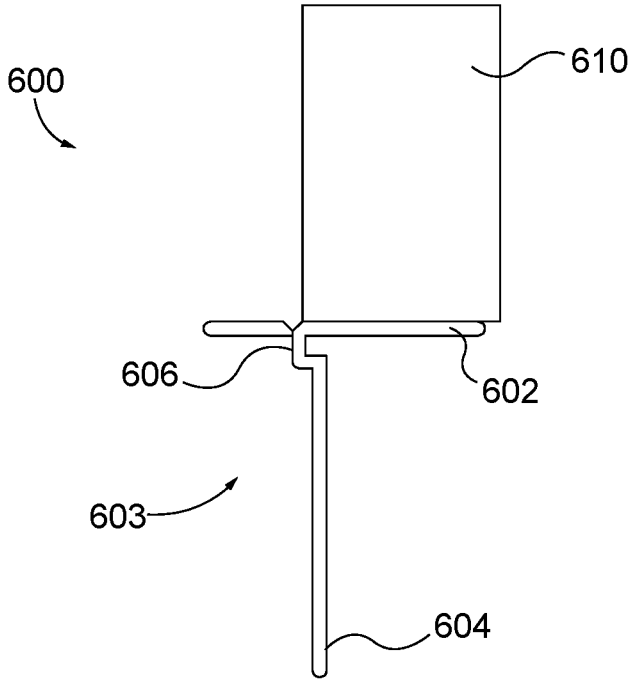
FIG. 17 depicts a rear elevational view of the finishing accessory of FIG. 15.
Figure 18:
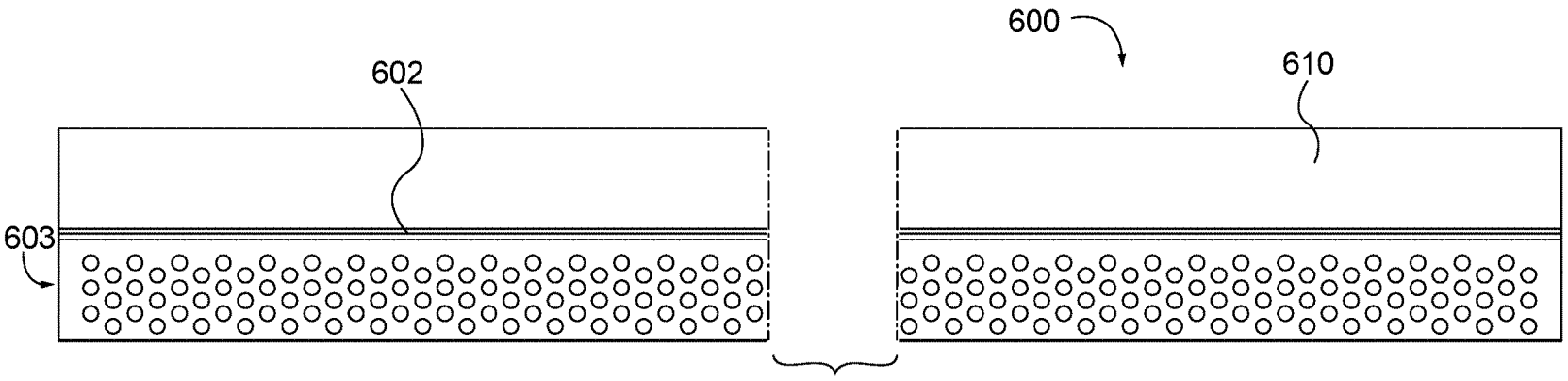
FIG. 18 depicts a left side elevational view of the finishing accessory of FIG. 15.
Figure 19:
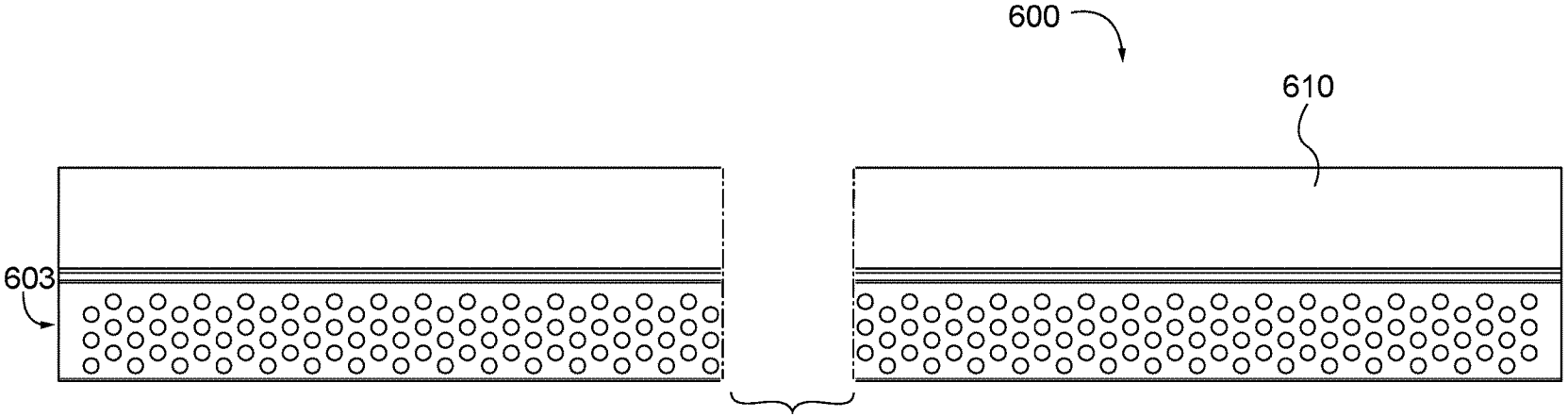
FIG. 19 depicts a right side elevational view of the finishing accessory of FIG. 15.
Figure 20:
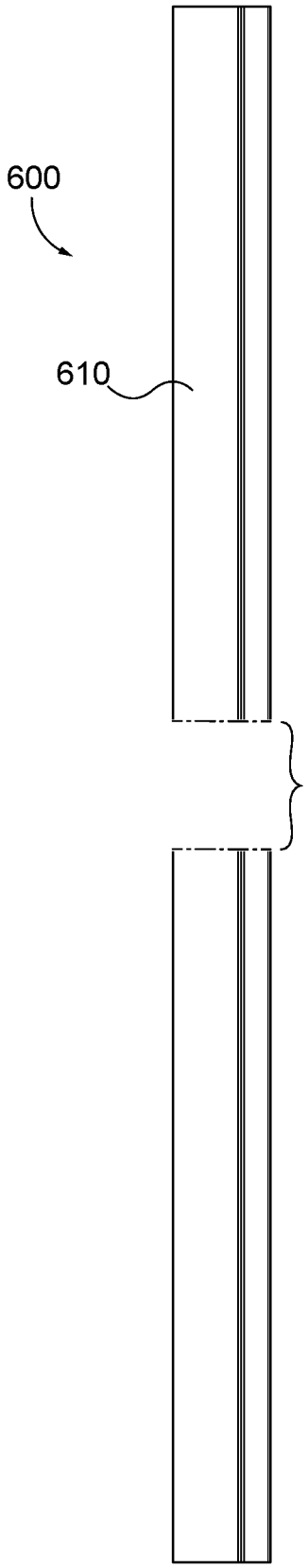
FIG. 20 depicts a top plan view of the finishing accessory of FIG. 15.
Figure 21:
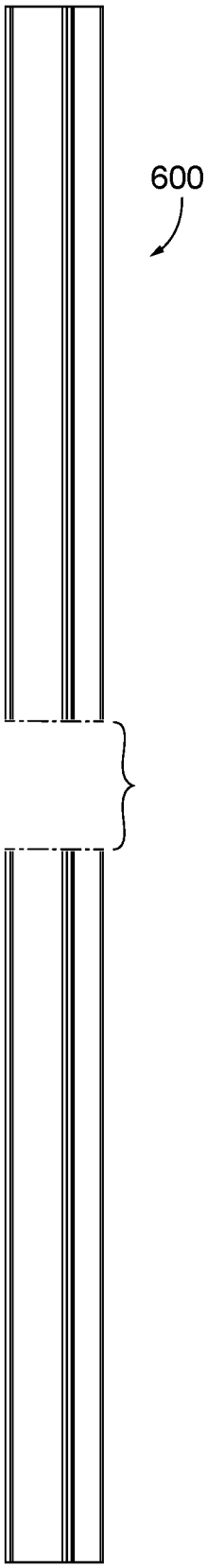
FIG. 21 depicts a bottom plan view of the finishing accessory of FIG. 15.

FIG. 14 depicts an exemplary alternative wall assembly (1010) that is similar to wall assemblies (10, 10') described above, except that wall assembly (1010) includes finishing accessory (500) instead of finishing accessory (100, 100'). Accordingly, the portions of wall assembly (1010) that are identical to those in wall assemblies (10, 10') will not be described again. In addition, portions of wall assembly (1010) that are identical to those in wall assembly (10) are labeled with the same item numbers as above.

In the wall assembly (1010) illustrated in FIG. 14, finishing accessory (500) is installed on top of wallboard panel (40) such that strip (110) is positioned within gap (60) between top edge (42) of wallboard panel (40) and the lower surface (51) of horizontal support structure (50). As shown, first leg (502) is positioned along top edge (42) of wallboard panel (40) and second leg (504) extends downwardly from lip (506) and contacts outer vertical surface (44) of wallboard panel (40). Strip (510) may be dimensioned such that upper surface (516) of strip (510) contacts the lower surface (51) of horizontal support structure (50). In embodiments where the upper surface (516) of strip (510) contacts the lower surface (51) of horizontal support structure (50), that contact may provide a seal that helps prevent the spread of smoke at the head of wall joint and reduces the amount of sound that passes through the head of wall joint, even when strip (510) is in a normal or unexpanded state. In embodiments where strip (510) comprises material with intumescent properties, at least a portion of strip (510) may be configured to expand when exposed to elevated temperatures, thereby expanding into surrounding gaps and substantially sealing the head of wall joint to help prevent the spread of smoke and fire through the joint.

In embodiments where strip (510) comprises compressible material, such a construction allows wallboard panel (40) to travel vertically during deflections because strip (510) can be compressed as wallboard panel (40) travels upward toward horizontal supporting structure (50). In embodiments where strip (510) comprises material that is also resilient, strip (510) can then return to its original size to substantially fill gap (60) as wallboard panel (40) travels downward away from horizontal supporting structure (50). This may help prevent cracking of wallboard panel (40) and surrounding materials during deflections.

As shown in FIG. 14, gap (60) is substantially filled by first leg (502) of finishing accessory (500) and strip (510) in both the vertical and horizontal dimensions (i.e., height and width, respectively) of gap (60). In other words, the width of first leg (502) and strip (510) are substantially equal to the width of gap (60), although in the illustrated embodiment, the width of strip (510) is greater than the width of leg (502). In other embodiments first leg (502) and/or strip (510) may comprise a width that is less than the width of gap (60) which may result in the interior side surface (513) of strip (510) being horizontally spaced apart from the leg or flange (24) of header track (20). In other embodiments, similar to the embodiment shown in FIG. 6, the first leg (502) may be wider than strip (510). As shown in FIG. 14, the combined height of first leg (502) and strip (510) is substantially equal to the height of gap (60) such that the upper surface (516) of strip (510) contacts the lower surface (51) of horizontal support structure (50). In other embodiments, the combined height of first leg (502) and strip (510) may be greater than the height of gap (60). In this instance, finishing accessory may still be installed as shown as strip (510) may be compressed to fit within gap (60). By way of example only, both gap (60) and the combined height of strip (510) and first leg (502) may be approximately ⅜ inches. It should be understood that gap (60) and the combined height of strip (510) and first leg (502) may be other suitable sizes depending on the particular application.

FIGS. 15-22 depict another exemplary alternative finishing accessory (600). Finishing accessory (600) is shown in FIGS. 15-21 with a symbolic break to indicate that it could be any length, similar to finishing accessory (100) described above. As shown, finishing accessory (600) is similar to finishing accessories (100, 200, 300, 400) described above, except that strip (610) comprises a different cross-section and relative width compared to strips (110, 210, 310, 410) described above. Finishing accessory (600) is also identical to finishing accessory (500) described above, except that finishing accessory (600) also includes a removable leg (620) similar to removable leg (120) described above. Accordingly, the portions of finishing accessory (600) that are identical to those in finishing accessories (100, 200, 300, 400) will not be described again. Unlike strips (110, 210, 310, 410) described above that comprise a rectangular cross-section where the width of strips (110, 210, 310, 410) is greater than the height of strips (110, 210, 310, 410), in the illustrated embodiment, strip (610) comprises a rectangular cross-section where the height of strip (610) is greater than the width of strip (610), similar to strip (510) described above. In addition, in the embodiment shown in FIGS. 15-22, strip (610) is positioned on first leg (602), such that strip (610) extends laterally away from the fixed end of second leg (602) beyond the free end of first leg (602).

In the illustrated embodiment, strip (610) is a separate component attached to first leg (602) of finishing accessory (600). Strip (610) may be attached to first leg (602) using an adhesive, one or more conventional fasteners, or any other suitable attachment methods. In embodiments that use a layer of adhesive to attach strip (610) to first leg (602), the adhesive may be fire resistant or, in other words, able to maintain its adhesive qualities at elevated temperatures. Although strip (610) is shown as comprising one layer of material, similar to strips (210, 310, 510) described above, in other embodiments strip (610) may comprise two or more layers of material, similar to strips (110, 410) described above. In addition, strip (610) may comprise material similar to the material for strips (110, 210, 310, 410, 510) described above (e.g., closed cell foam, open cell foam, etc.) and that material may have any of the properties (e.g., fire resistant, intumescent, sound insulating, compressible and/or resilient, etc.) described above with regard to strips (110, 210, 310, 410, 510). Similarly, bead (603) may be constructed similarly and may be made out of similar materials as beads (103, 203, 303, 403, 503) described above.

Figure 22:
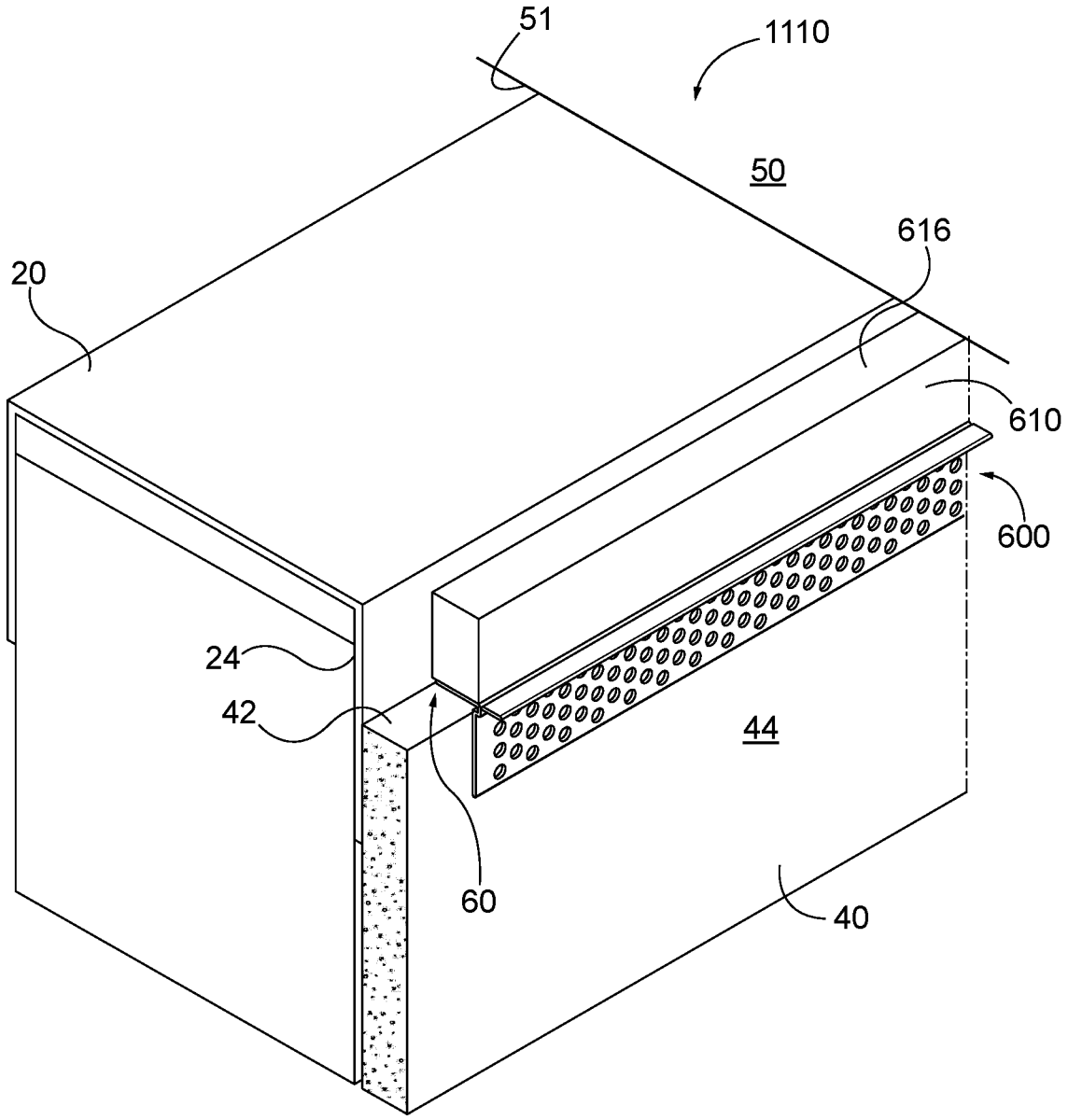
FIG. 22 depicts a partial perspective view of an alternate exemplary wall assembly that includes the finishing accessory of FIG. 15.
Figure 23:
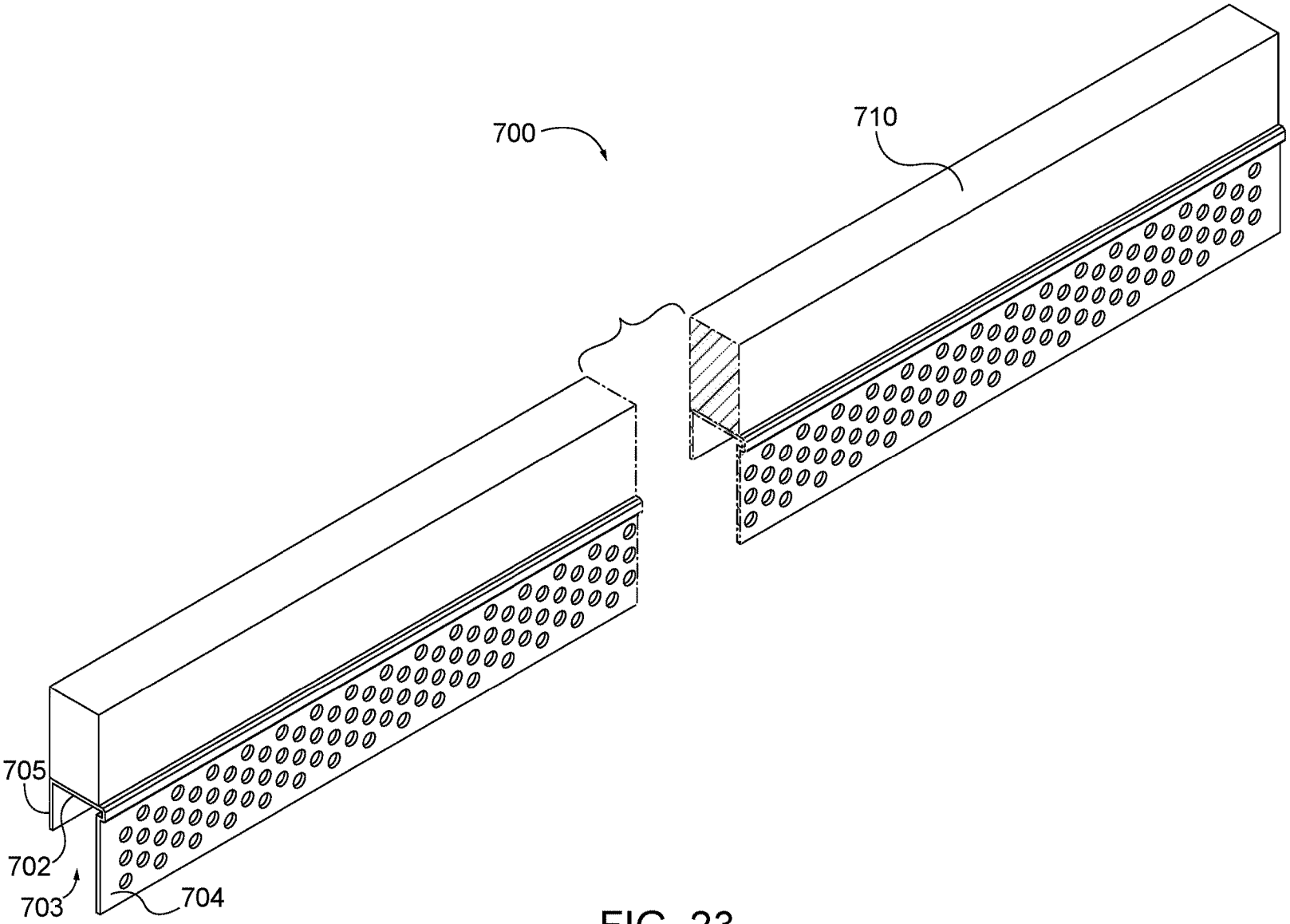
FIG. 23 depicts a top perspective view of another alternate exemplary finishing accessory.
Figure 24:
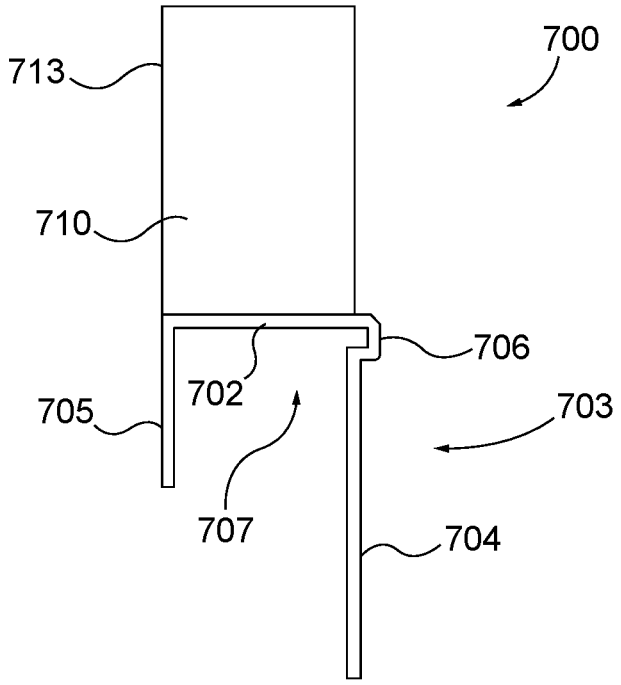
FIG. 24 depicts a front elevational view of the finishing accessory of FIG. 23.
Figure 25:
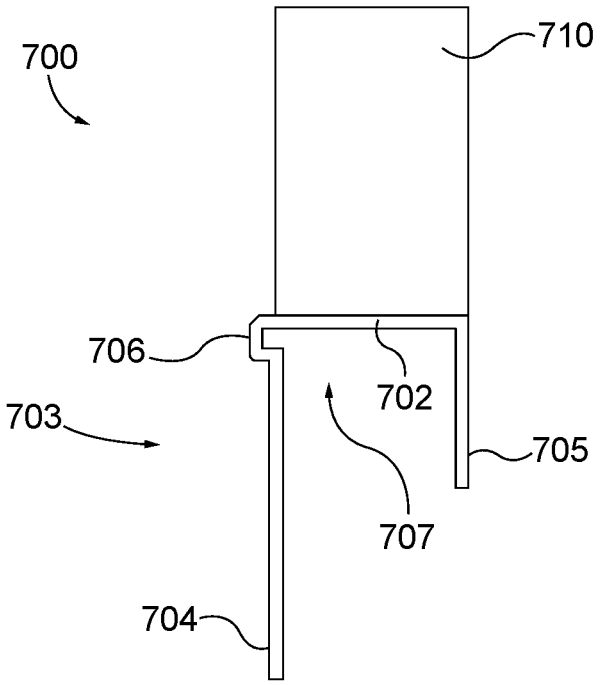
FIG. 25 depicts a rear elevational view of the finishing accessory of FIG. 23.
Figure 26:
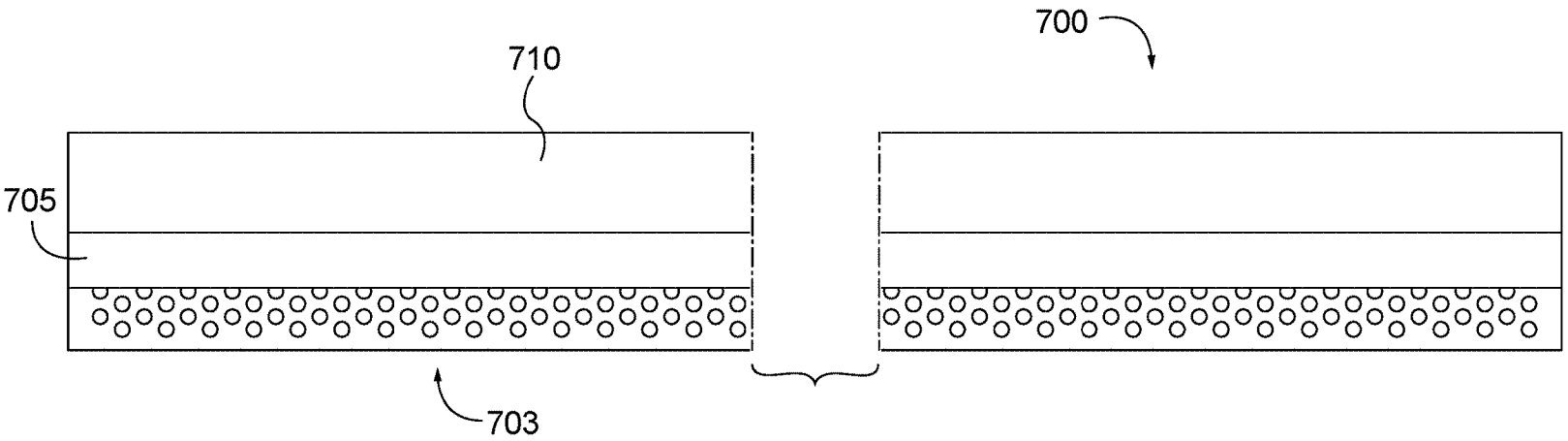
FIG. 26 depicts a left side elevational view of the finishing accessory of FIG. 23.
Figure 27:
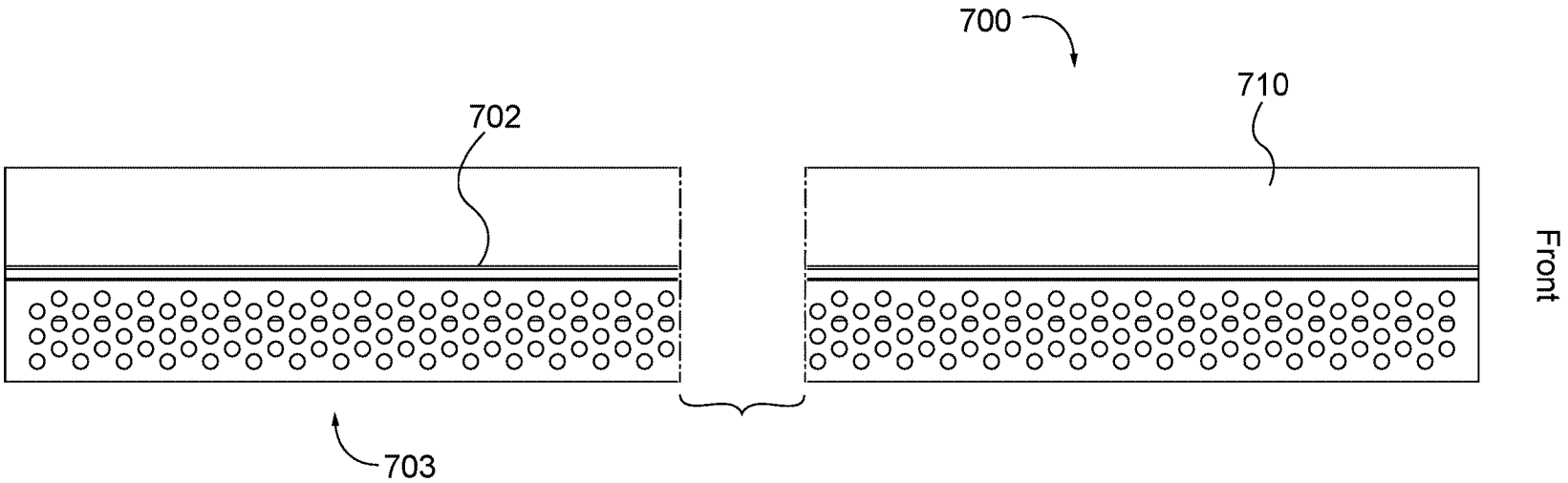
FIG. 27 depicts a right side elevational view of the finishing accessory of FIG. 23.
Figure 28:
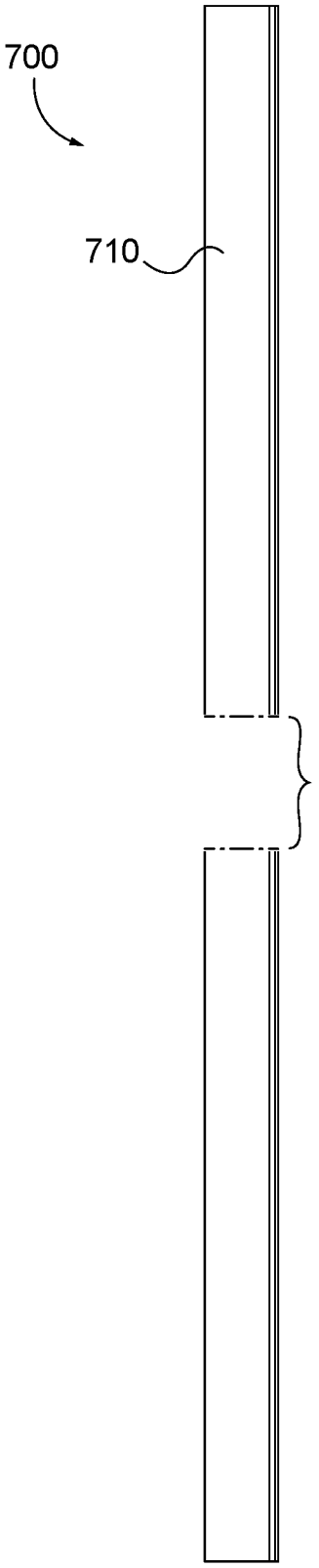
FIG. 28 depicts a top plan view of the finishing accessory of FIG. 23.
Figure 29:
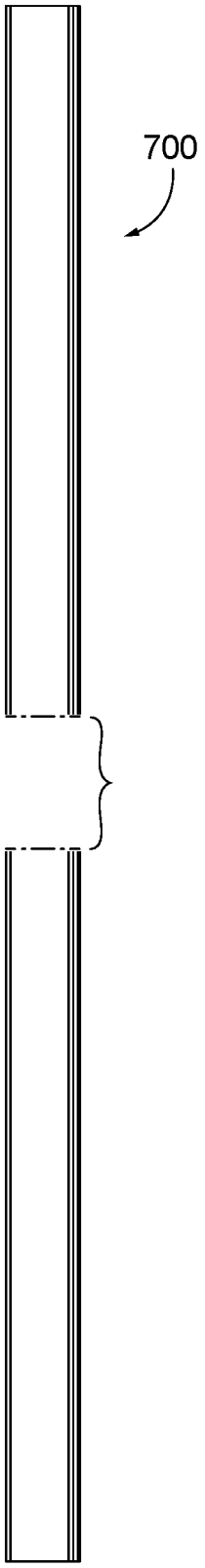
FIG. 29 depicts a bottom plan view of the finishing accessory of FIG. 23.

FIG. 22 depicts an exemplary alternative wall assembly (1110) that is similar to wall assemblies (10, 10', 1010) described above, except that wall assembly (1110) includes finishing accessory (600) instead of finishing accessory (100, 100', 500). Accordingly, the portions of wall assembly (1110) that are identical to those in wall assemblies (10, 10', 1010) will not be described again. In addition, portions of wall assembly (1110) that are identical to those in wall assembly (10) are labeled with the same item numbers as above.

In the wall assembly (1110) illustrated in FIG. 22, finishing accessory (600) is installed on top of wallboard panel (40) such that strip (610) is positioned within gap (60) between top edge (42) of wallboard panel (40) and the lower surface (51) of horizontal support structure (50). As shown, first leg (602) is positioned along top edge (42) of wallboard panel (40) and second leg (604) extends downwardly from lip (606) and contacts outer vertical surface (44) of wallboard panel (40). Strip (610) may be dimensioned such that upper surface (616) of strip (610) contacts the lower surface (51) of horizontal support structure (50). In embodiments where the upper surface (616) of strip (610) contacts the lower surface (51) of horizontal support structure (50), that contact may provide a seal that helps prevent the spread of smoke at the head of wall joint and reduces the amount of sound that passes through the head of wall joint, even when strip (610) is in a normal or unexpanded state. In embodiments where strip (610) comprises material with intumescent properties, at least a portion of strip (610) may be configured to expand when exposed to elevated temperatures, thereby expanding into surrounding gaps and substantially sealing the head of wall joint to help prevent the spread of smoke and fire through the joint.

In embodiments where strip (610) comprises compressible material, such a construction allows wallboard panel (40) to travel vertically during deflections because strip (610) can be compressed as wallboard panel (40) travels upward toward horizontal supporting structure (50). In embodiments where strip (610) comprises material that is also resilient, strip (610) can then return to its original size to substantially fill gap (60) as wallboard panel (40) travels downward away from horizontal supporting structure (50). This may help prevent cracking of wallboard panel (40) and surrounding materials during deflections.

As shown in FIG. 22, gap (60) is substantially filled by first leg (602) of finishing accessory (600) and strip (610) in both the vertical and horizontal dimensions (i.e., height and width, respectively) of gap (60). In other words, the width of first leg (602) and strip (610) are substantially equal to the width of gap (60), although in the illustrated embodiment, the width of strip (610) is greater than the width of leg (602). In other embodiments first leg (602) and/or strip (610) may comprise a width that is less than the width of gap (60) which may result in the interior side surface (613) of strip (610) being horizontally spaced apart from the leg or flange (24) of header track (20). In other embodiments, similar to the embodiment shown in FIG. 6, the first leg (602) may be wider than strip (610). As shown in FIG. 22, the combined height of first leg (602) and strip (610) is substantially equal to the height of gap (60) such that the upper surface (616) of strip (610) contacts the lower surface (51) of horizontal support structure (50). In other embodiments, the combined height of first leg (602) and strip (610) may be greater than the height of gap (60). In this instance, finishing accessory may still be installed as shown as strip (610) may be compressed to fit within gap (60). By way of example only, both gap (60) and the combined height of strip (610) and first leg (602) may be approximately ⅜ inches. It should be understood that gap (60) and the combined height of strip (610) and first leg (602) may be other suitable sizes depending on the particular application.

FIGS. 23-30 depict another exemplary alternative finishing accessory (700). Finishing accessory (700) is shown in FIGS. 23-29 with a symbolic break to indicate that it could be any length, similar to finishing accessory (100) described above. As shown, finishing accessory (700) is similar to finishing accessories (100, 200, 300, 400) described above, except that bead (703) comprises a substantially J-shaped profile instead of the substantially L-shaped profile of beads (103, 203, 303, 403) described above and strip (710) comprises a different cross-section and relative width compared to strips (110, 210, 310, 410) described above. Accordingly, the portions of finishing accessory (700) that are identical to those in finishing accessories (100, 200, 300, 400) will not be described again.

In the embodiment illustrated in FIGS. 23-30, finishing accessory (700) comprises a bead (703) that is a J-bead. As shown, bead (703) comprises a first leg (702), a second leg (704), a third leg (705), and a lip (706). The profile formed by first leg (702), second leg (704), third leg (705), and lip (706) is a substantially "J" shaped profile. In the illustrated embodiment, first leg is connected to lip (706) at a first end and connected to third leg (705) at a second end. As shown, third leg (705) extends downwardly from first leg (702). First leg (702) and third leg (705) may be substantially perpendicular to each other and third leg (705) may be substantially parallel to second leg (704). In this embodiment, third leg (705) is shorter than second leg (704). As shown, first leg (702), second leg (704), and third leg (705) form a pocket (707) that may be configured to receive the upper end of wallboard panel (40).

In addition, unlike strips (110, 210, 310, 410) described above that comprise a rectangular cross-section where the width of strips (110, 210, 310, 410) is greater than the height of strips (110, 210, 310, 410), in the illustrated embodiment, strip (710) comprises a rectangular cross-section where the height of strip (710) is greater than the width of strip (710), similar to strips (510, 610) described above. In addition, in some embodiments, strip (710) may be positioned on first leg (702), such that strip (710) extends laterally away from the first end of second leg (702) beyond the second end of first leg (702) and the vertical plane that contains third leg (705).

In the illustrated embodiment, strip (710) is a separate component attached to first leg (702) of finishing accessory (700). Strip (710) may be attached to first leg (702) using an adhesive, one or more conventional fasteners, or any other suitable attachment methods. In embodiments that use a layer of adhesive to attach strip (710) to first leg (702), the adhesive may be fire resistant or, in other words, able to maintain its adhesive qualities at elevated temperatures. Although strip (710) is shown as comprising one layer of material, similar to strips (210, 310, 510, 610) described above, in other embodiments strip (710) may comprise two or more layers of material, similar to strips (110, 410) described above. In addition, strip (710) may comprise material similar to the material for strips (110, 210, 310, 410, 510, 610) described above (e.g., closed cell foam, open cell foam, etc.) and that material may have any of the properties (e.g., fire resistant, intumescent, sound insulating, compressible and/or resilient, etc.) described above with regard to strips (110, 210, 310, 410, 510, 610). Similarly, bead (703) may be constructed similarly and may be made out of similar materials as beads (103, 203, 303, 403, 503, 603) described above.

Figure 30:
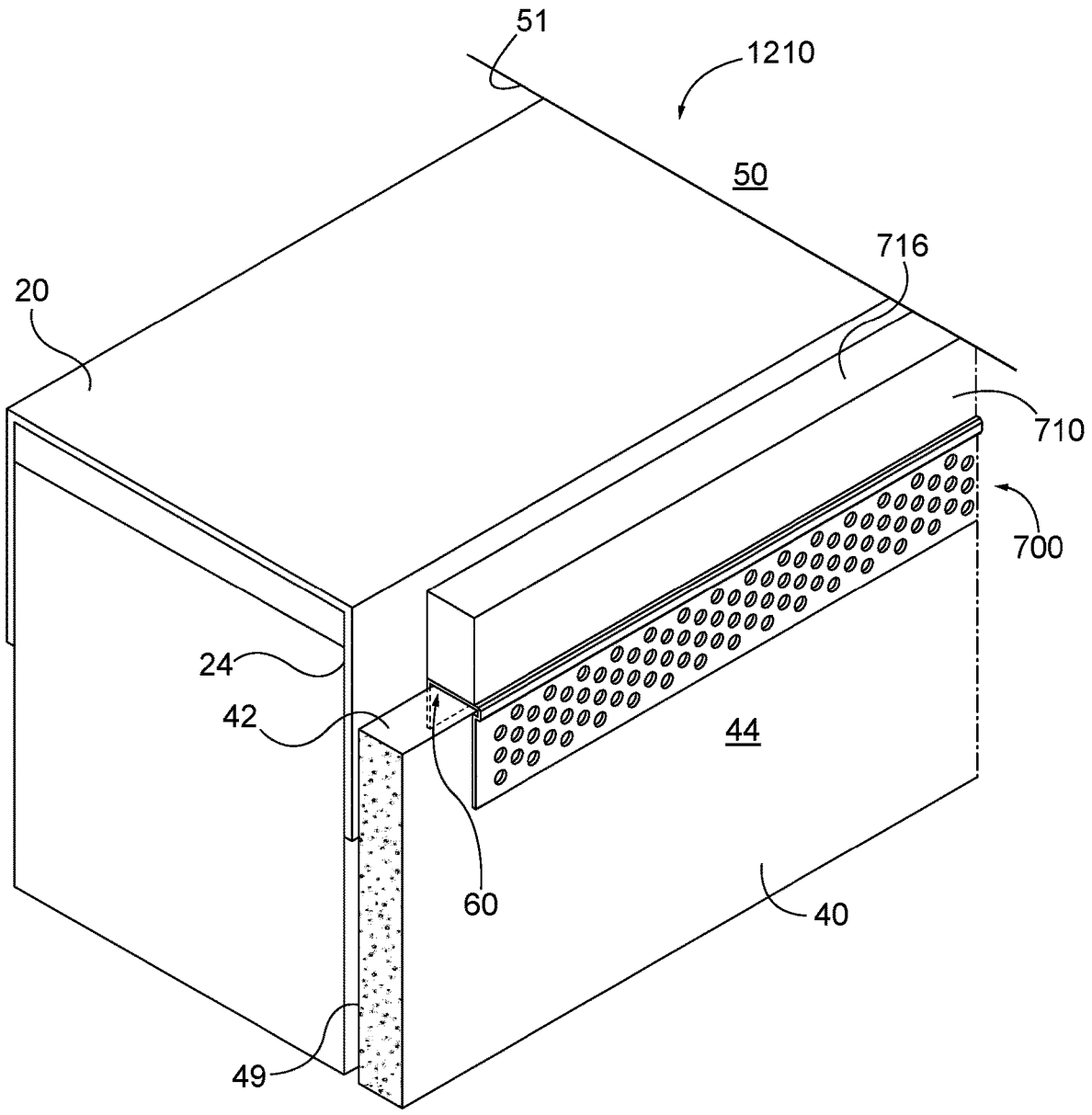
FIG. 30 depicts a partial perspective view of an alternate exemplary wall assembly that includes the finishing accessory of FIG. 23.
Figure 31:
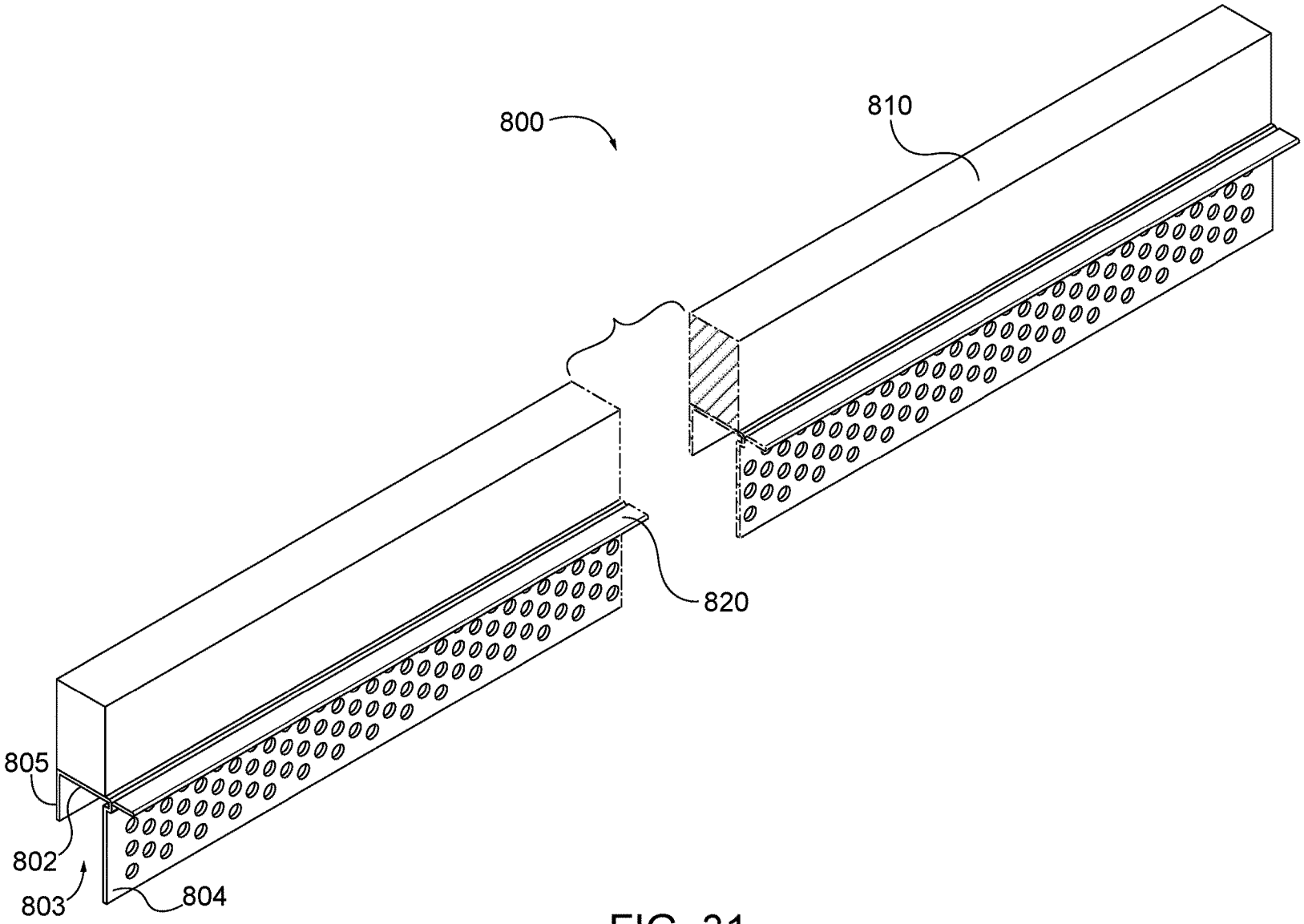
FIG. 31 depicts a top perspective view of another alternate exemplary finishing accessory.
Figure 32:
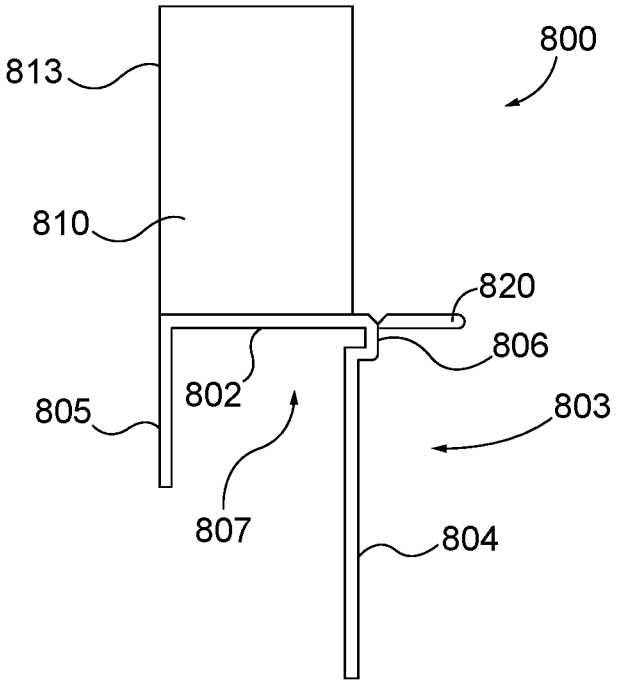
FIG. 32 depicts a front elevational view of the finishing accessory of FIG. 31.
Figure 33:
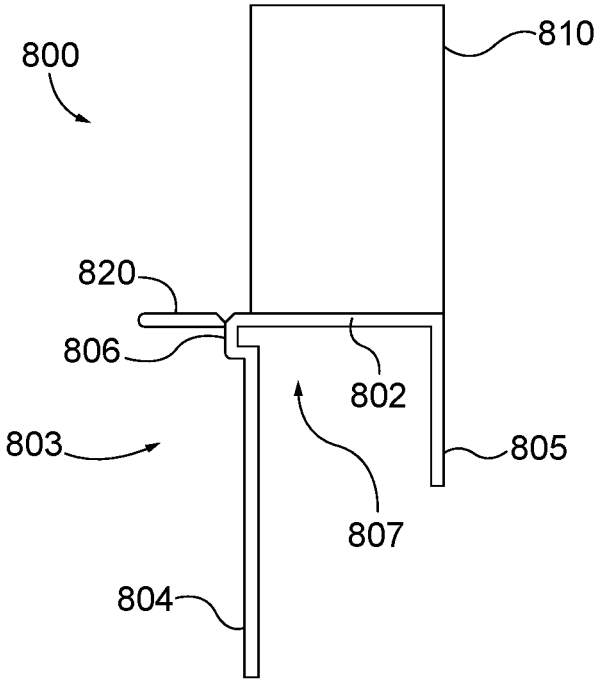
FIG. 33 depicts a rear elevational view of the finishing accessory of FIG. 31.
Figure 34:
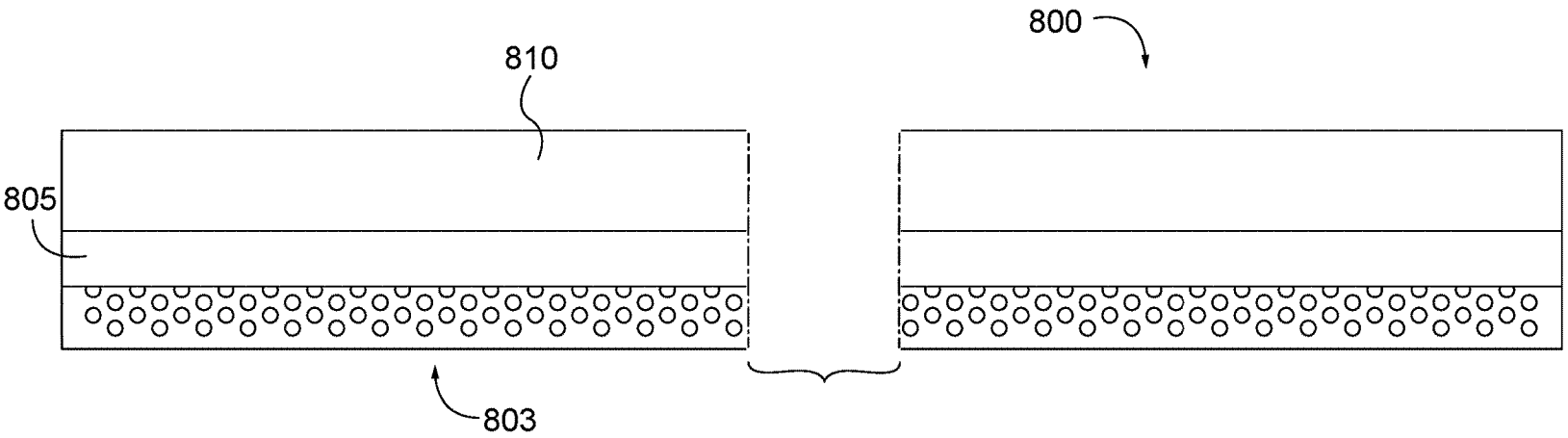
FIG. 34 depicts a left side elevational view of the finishing accessory of FIG. 31.
Figure 35:
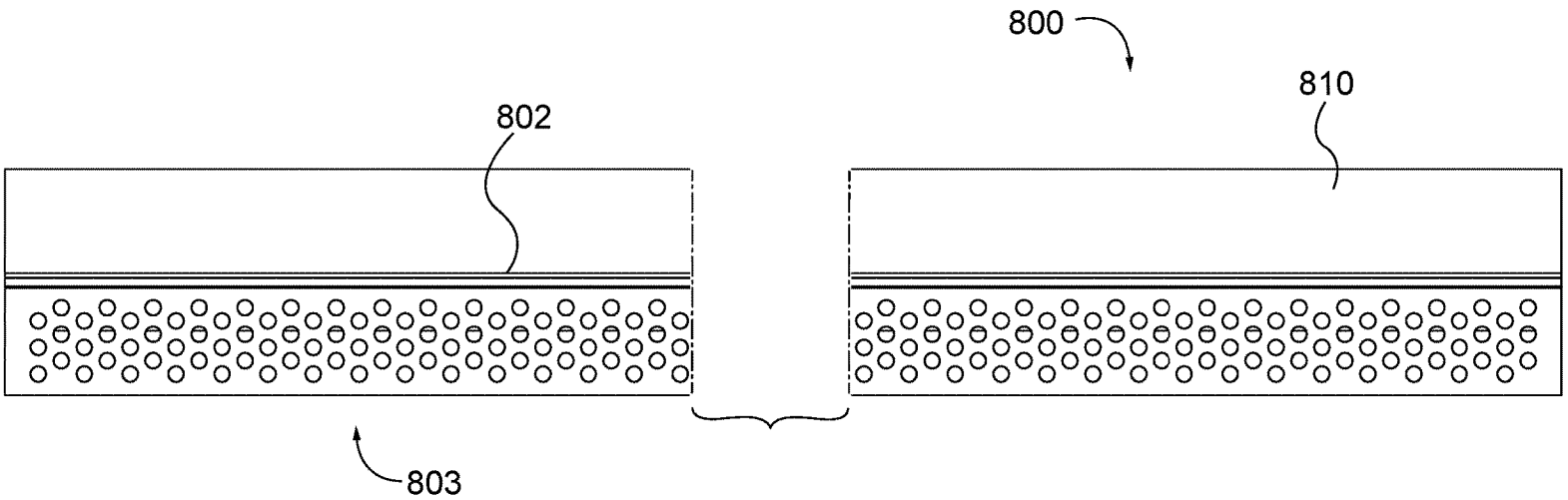
FIG. 35 depicts a right side elevational view of the finishing accessory of FIG. 31.
Figure 36:
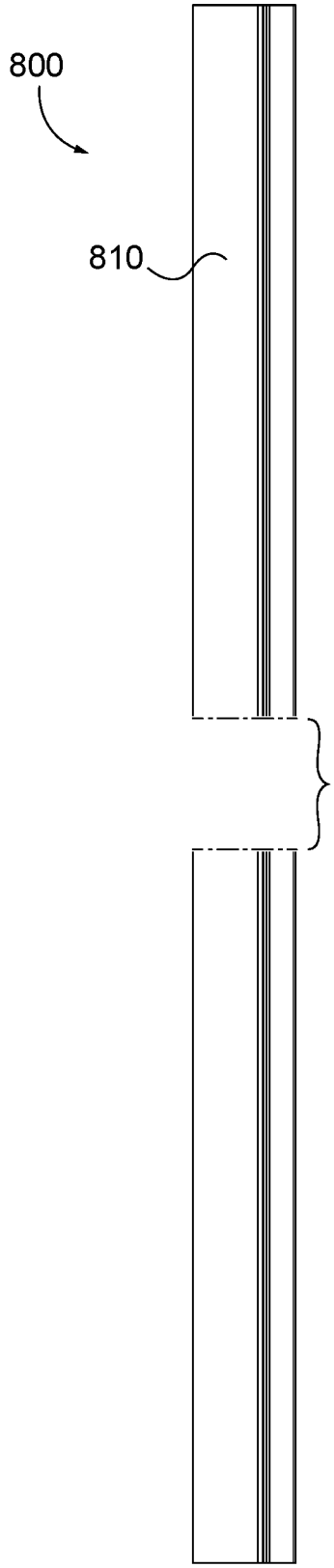
FIG. 36 depicts a top plan view of the finishing accessory of FIG. 31.
Figure 37:
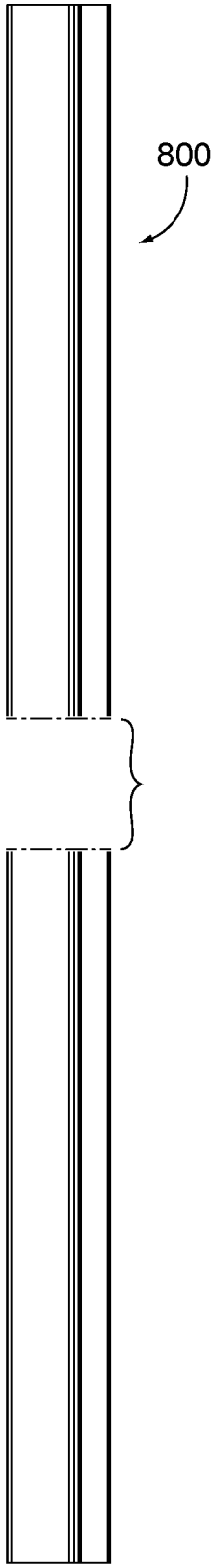
FIG. 37 depicts a bottom plan view of the finishing accessory of FIG. 31.

FIG. 30 depicts an exemplary alternative wall assembly (1210) that is similar to wall assemblies (10, 10', 1010, 1110) described above, except that wall assembly (1210) includes finishing accessory (700) instead of finishing accessory (100, 100', 500, 600). Accordingly, the portions of wall assembly (1210) that are identical to those in wall assemblies (10, 10', 1010, 1110) will not be described again. In addition, portions of wall assembly (1210) that are identical to those in wall assembly (10) are labeled with the same item numbers as above.

In the wall assembly (1210) illustrated in FIG. 30, finishing accessory (700) is installed on top of wallboard panel (40) such that strip (710) is positioned within gap (60) between top edge (42) of wallboard panel (40) and the lower surface (51) of horizontal support structure (50). As shown, first leg (702) is positioned along top edge (42) of wallboard panel (40) and second leg (604) extends downwardly from lip (606) and contacts outer vertical surface (44) of wallboard panel (40). In addition, as shown, third leg (705) is positioned between wallboard panel (40) and leg or flange (24) of header track (20) such that the upper end of wallboard panel (40) is received within pocket (703) of finishing accessory (700). In some embodiments, third leg (705) may be in contact with the inner vertical surface (49) of wallboard panel (40) and/or the outer surface of flange (24) of header track (20). Strip (710) may be dimensioned such that upper surface (716) of strip (710) contacts the lower surface (51) of horizontal support structure (50). In embodiments where the upper surface (716) of strip (710) contacts the lower surface (51) of horizontal support structure (50), that contact may provide a seal that helps prevent the spread of smoke at the head of wall joint and reduces the amount of sound that passes through the head of wall joint, even when strip (710) is in a normal or unexpanded state. In embodiments where strip (710) comprises material with intumescent properties, at least a portion of strip (710) may be configured to expand when exposed to elevated temperatures, thereby expanding into surrounding gaps and substantially sealing the head of wall joint to help prevent the spread of smoke and fire through the joint.

In embodiments where strip (710) comprises compressible material, such a construction allows wallboard panel (40) to travel vertically during deflections because strip (710) can be compressed as wallboard panel (40) travels upward toward horizontal supporting structure (50). In embodiments where strip (710) comprises material that is also resilient, strip (710) can then return to its original size to substantially fill gap (60) as wallboard panel (40) travels downward away from horizontal supporting structure (50). This may help prevent cracking of wallboard panel (40) and surrounding materials during deflections.

As shown in FIG. 30, gap (60) is substantially filled by first leg (702) of finishing accessory (700) and strip (710) in both the vertical and horizontal dimensions (i.e., height and width, respectively) of gap (60). In other words, the width of first leg (702) and strip (710) are substantially equal to the width of gap (60), although in the illustrated embodiment, the width of strip (710) is greater than the width of leg (702). In other embodiments first leg (702) and/or strip (710) may comprise a width that is less than the width of gap (60) which may result in the interior side surface (713) of strip (710) being horizontally spaced apart from the leg or flange (24) of header track (20). In other embodiments, similar to the embodiment shown in FIG. 6, the first leg (702) may be wider than strip (710). As shown in FIG. 30, the combined height of first leg (702) and strip (710) is substantially equal to the height of gap (60) such that the upper surface (716) of strip (710) contacts the lower surface (51) of horizontal support structure (50). In other embodiments, the combined height of first leg (702) and strip (710) may be greater than the height of gap (60). In this instance, finishing accessory may still be installed as shown as strip (710) may be compressed to fit within gap (60). By way of example only, both gap (60) and the combined height of strip (710) and first leg (702) may be approximately ⅜ inches. It should be understood that gap (60) and the combined height of strip (710) and first leg (702) may be other suitable sizes depending on the particular application.

FIGS. 31-38 depict another exemplary alternative finishing accessory (800). Finishing accessory (800) is shown in FIGS. 31-37 with a symbolic break to indicate that it could be any length, similar to finishing accessory (100) described above. As shown, finishing accessory (800) is similar to finishing accessories (100, 200, 300, 400) described above, except that bead (803) comprises a substantially J-shaped profile instead of the substantially L-shaped profile of beads (103, 203, 303, 403) described above and strip (810) comprises a different cross-section and relative width compared to strips (110, 210, 310, 410) described above. Finishing accessory (800) is also identical to finishing accessory (700) described above, except that finishing accessory (800) also includes a removable leg (820) similar to removable leg (120) described above. Accordingly, the portions of finishing accessory (800) that are identical to those in finishing accessories (100, 200, 300, 400) will not be described again.

In the embodiment illustrated in FIGS. 31-38, finishing accessory (800) comprises a bead (803) that is a J-bead. As shown, bead (803) comprises a first leg (802), a second leg (804), a third leg (805), a lip (806), and a removable leg (820). The profile formed by first leg (802), second leg (804), third leg (805), and lip (806) is a substantially "J" shaped profile. In the illustrated embodiment, first leg is connected to lip (806) at a first end and connected to third leg (805) at a second end. As shown, third leg (805) extends downwardly from first leg (802). First leg (802) and third leg (805) may be substantially perpendicular to each other and third leg (805) may be substantially parallel to second leg (804). In this embodiment, third leg (805) is shorter than second leg (804). As shown, first leg (802), second leg (804), and third leg (805) form a pocket (807) that may be configured to receive the upper end of wallboard panel (40).

In addition, unlike strips (110, 210, 310, 410) described above that comprise a rectangular cross-section where the width of strips (110, 210, 310, 410) is greater than the height of strips (110, 210, 310, 410), in the illustrated embodiment, strip (810) comprises a rectangular cross-section where the height of strip (810) is greater than the width of strip (810), similar to strips (510, 610, 710) described above. In addition, in some embodiments, strip (810) may be positioned on first leg (802), such that strip (810) extends laterally away from the first end of second leg (802) beyond the second end of first leg (802) and the vertical plane that contains third leg (805).

In the illustrated embodiment, strip (810) is a separate component attached to first leg (802) of finishing accessory (800). Strip (810) may be attached to first leg (802) using an adhesive, one or more conventional fasteners, or any other suitable attachment methods. In embodiments that use a layer of adhesive to attach strip (810) to first leg (802), the adhesive may be fire resistant or, in other words, able to maintain its adhesive qualities at elevated temperatures. Although strip (810) is shown as comprising one layer of material, similar to strips (210, 310, 510, 610, 710) described above, in other embodiments strip (810) may comprise two or more layers of material, similar to strips (110, 410) described above. In addition, strip (810) may comprise material similar to the material for strips (110, 210, 310, 410, 510, 610, 710) described above (e.g., closed cell foam, open cell foam, etc.) and that material may have any of the properties (e.g., fire resistant, intumescent, sound insulating, compressible and/or resilient, etc.) described above with regard to strips (110, 210, 310, 410, 510, 610, 710). Similarly, bead (803) may be constructed similarly and may be made out of similar materials as beads (103, 203, 303, 403, 503, 603, 703) described above.

Figure 38:
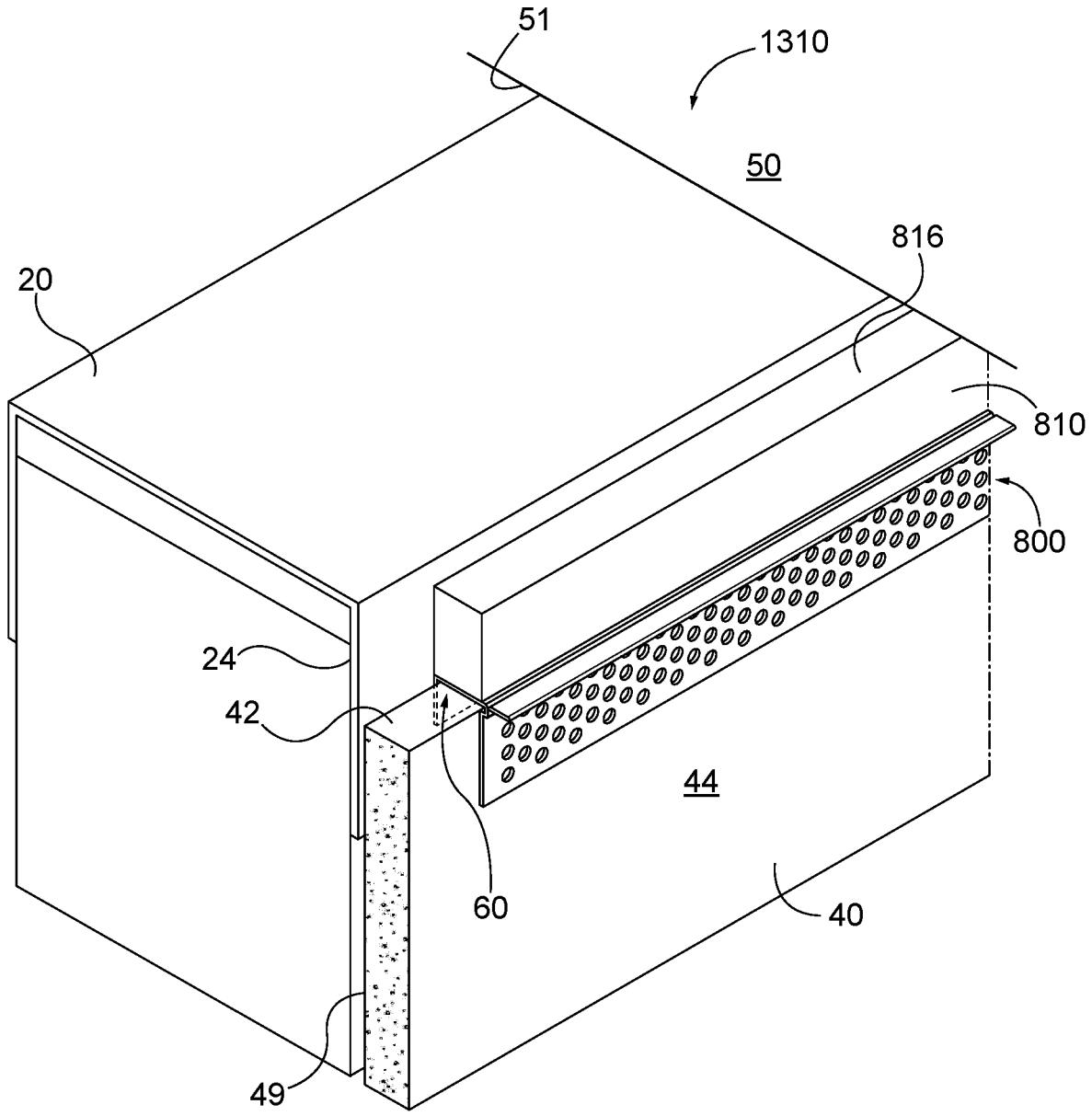
FIG. 38 depicts a partial perspective view of an alternate exemplary wall assembly that includes the finishing accessory of FIG. 31.

FIG. 38 depicts an exemplary alternative wall assembly (1310) that is similar to wall assemblies (10, 10', 1010, 1110, 1210) described above, except that wall assembly (1310) includes finishing accessory (800) instead of finishing accessory (100, 100', 500, 600, 700). Accordingly, the portions of wall assembly (1310) that are identical to those in wall assemblies (10, 10', 1010, 1110, 1210) will not be described again. In addition, portions of wall assembly (1310) that are identical to those in wall assembly (10) are labeled with the same item numbers as above.

In the wall assembly (1310) illustrated in FIG. 38, finishing accessory (800) is installed on top of wallboard panel (40) such that strip (810) is positioned within gap (60) between top edge (42) of wallboard panel (40) and the lower surface (51) of horizontal support structure (50). As shown, first leg (802) is positioned along top edge (42) of wallboard panel (40) and second leg (804) extends downwardly from lip (806) and contacts outer vertical surface (44) of wallboard panel (40). In addition, as shown, third leg (805) is positioned between wallboard panel (40) and leg or flange (24) of header track (20) such that the upper end of wallboard panel (40) is received within pocket (803) of finishing accessory (800). In some embodiments, third leg (805) may be in contact with the inner vertical surface (49) of wallboard panel (40) and/or the outer surface of flange (24) of header track (20). Strip (810) may be dimensioned such that upper surface (816) of strip (810) contacts the lower surface (51) of horizontal support structure (50). In embodiments where the upper surface (816) of strip (810) contacts the lower surface (51) of horizontal support structure (50), that contact may provide a seal that helps prevent the spread of smoke at the head of wall joint and reduces the amount of sound that passes through the head of wall joint, even when strip (810) is in a normal or unexpanded state. In embodiments where strip (810) comprises material with intumescent properties, at least a portion of strip (810) may be configured to expand when exposed to elevated temperatures, thereby expanding into surrounding gaps and substantially sealing the head of wall joint to help prevent the spread of smoke and fire through the joint.

In embodiments where strip (810) comprises compressible material, such a construction allows wallboard panel (40) to travel vertically during deflections because strip (810) can be compressed as wallboard panel (40) travels upward toward horizontal supporting structure (50). In embodiments where strip (810) comprises material that is also resilient, strip (810) can then return to its original size to substantially fill gap (60) as wallboard panel (40) travels downward away from horizontal supporting structure (50). This may help prevent cracking of wallboard panel (40) and surrounding materials during deflections.

As shown in FIG. 38, gap (60) is substantially filled by first leg (802) of finishing accessory (800) and strip (810) in both the vertical and horizontal dimensions (i.e., height and width, respectively) of gap (60). In other words, the width of first leg (802) and strip (810) are substantially equal to the width of gap (60), although in the illustrated embodiment, the width of strip (810) is greater than the width of leg (802). In other embodiments first leg (802) and/or strip (810) may comprise a width that is less than the width of gap (60) which may result in the interior side surface (813) of strip (810) being horizontally spaced apart from the leg or flange (24) of header track (20). In other embodiments, similar to the embodiment shown in FIG. 6, the first leg (802) may be wider than strip (810). As shown in FIG. 38, the combined height of first leg (802) and strip (810) is substantially equal to the height of gap (60) such that the upper surface (816) of strip (810) contacts the lower surface (51) of horizontal support structure (50). In other embodiments, the combined height of first leg (802) and strip (810) may be greater than the height of gap (60). In this instance, finishing accessory may still be installed as shown as strip (810) may be compressed to fit within gap (60). By way of example only, both gap (60) and the combined height of strip (810) and first leg (802) may be approximately ⅜ inches. It should be understood that gap (60) and the combined height of strip (810) and first leg (802) may be other suitable sizes depending on the particular application.

Finishing accessories (100', 200, 300, 400, 500, 600, 700, 800) may be installed in a similar manner as finishing accessory (100) described above.

The beads (103, 103', 203, 303, 403, 503, 603, 703, 803) of finishing accessories (100, 100', 200, 300, 400, 500, 600, 700, 800) are shown as comprising an L-bead profile or a J-bead profile. In other embodiments, a finishing accessory may comprise a bead having any profile suitable to allow the finishing accessory to be installed on top of a wallboard panel such that the strip is effectively positioned within the gap between the top edge of the wallboard panel and a lower surface of an adjacent horizontal support structure (50), including but not limited to an L-bead with or without a removable leg and a J-bead with or without a removable leg.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed:

1. A wall assembly comprising:

(a) a horizontal support structure comprising a lower surface;

(b) a header track attached to the horizontal support structure, wherein the header track comprises a web;

(c) a stud comprising an upper end received within the header track;

(d) a wallboard panel comprising a width, a top edge and an outer vertical surface, wherein the wallboard panel is positioned such that there is a gap between the top edge of the wallboard panel and the lower surface of the horizontal support structure, wherein the gap comprises a gap width that is equal to the width of the wallboard panel; and (e) a framing accessory comprising (i) a first leg comprising an exterior surface, an interior surface opposite the exterior surface, a fixed end, and a free end opposite the fixed end of the first leg, (ii) a second leg oriented substantially perpendicular relative to the first leg, wherein the second leg comprises a plurality of openings defined therein, and (iii) a strip comprising a material selected from the group consisting of open cell foam and closed cell foam, wherein the strip comprises 1. a bottom surface, wherein the entire bottom surface is attached to the exterior surface of the first leg,
2. an upper surface opposite the bottom surface of the strip,
3. an interior side surface that extends between the bottom surface of the strip and the upper surface of the strip, and
4. an outer side surface opposite the interior side surface of the strip, wherein the strip extends at least to the free end of the first leg, wherein the framing accessory comprises a first height that extends from the interior surface of the first leg to the upper surface of the strip, wherein the first height of the framing accessory is at least 0.375 inches, wherein the bottom surface extends from the interior side surface to the outer side surface, wherein the framing accessory extends longitudinally between a first end and a second end, wherein the first leg is solid adjacent to the first end of the framing accessory, wherein the first leg and the strip of the framing accessory are positioned in the gap between the top edge of the wallboard panel and the lower surface of the horizontal support structure such that the first leg is positioned vertically below the web of the header track, the gap is substantially filled by the first leg and the strip, the upper surface of the strip contacts the lower surface of the horizontal support structure thereby creating a seal between the strip and the horizontal support structure, and the second leg of the framing accessory is positioned along the outer vertical surface of the wallboard panel.

2. The wall assembly of claim 1, wherein the strip is positioned along the first leg such that at least a portion of the strip extends laterally away from the fixed end of the first leg beyond the free end of the first leg.

3. The wall assembly of claim 1, wherein the framing accessory further comprises a lip, wherein the lip connects the first leg and the second leg.

4. The wall assembly of claim 3, wherein the lip comprises a vertical leg and a horizontal return, wherein the first leg is connected to the vertical leg of the lip and the second leg is connected to the horizontal return of the lip.

5. The wall assembly of claim 1, wherein the strip comprises a first layer of material and a second layer of material.

6. The wall assembly of claim 5, wherein at least one of the first layer of material and the second layer of material comprises material having intumescent properties.

7. The wall assembly of claim 1, wherein the first leg and the second leg comprise material having intumescent properties.

8. The wall assembly of claim 1, wherein the strip comprises a material having sound insulating properties.

9. The wall assembly of claim 1, wherein the strip comprises a strip width and the first leg comprises a first leg width, wherein the strip width is greater than the first leg width.

10. The wall assembly of claim 1, wherein at least 75% of the exterior surface of the first leg is covered by the strip.

11. The wall assembly of claim 1, wherein substantially the entire exterior surface of the first leg is covered by the strip.

12. The wall assembly of claim 1, wherein the framing accessory further comprises a removable leg, wherein the removable leg extends substantially parallel to the upper surface of the strip.

13. A wall assembly comprising:

(a) a horizontal support structure comprising a lower surface;

(b) a header track attached to the horizontal support structure, wherein the header track comprises a web;

(c) a stud comprising an upper end received within the header track;

(d) a wallboard panel comprising a width, a top edge and an outer vertical surface, wherein the wallboard panel is positioned such that there is a gap between the top edge of the wallboard panel and the lower surface of the horizontal support structure, wherein the gap comprises a gap width that is equal to the width of the wallboard panel; and (e) a framing accessory comprising
(i) a first leg comprising a fixed end and a free end, wherein the free end of the first leg is closer to the stud than the fixed end of the first leg,
(ii) a second leg oriented substantially perpendicular relative to the first leg, and
(iii) a strip comprising an upper surface, a bottom surface opposite the upper surface of the strip, an interior side surface that extends between the bottom surface of the strip and the upper surface of the strip, and an outer side surface opposite the interior side surface of the strip, wherein the interior side surface is substantially perpendicular to the first leg, wherein the strip comprises a material selected from the group consisting of open cell foam and closed cell foam, wherein the strip is attached to the first leg, (f) wherein the first leg and the strip of the framing accessory are positioned in the gap between the top edge of the wallboard panel and the lower surface of the horizontal support structure such that the first leg is positioned vertically below the web of the header track, the gap is substantially filled by the first leg and the strip, the upper surface of the strip contacts the lower surface of the horizontal support structure thereby creating a seal between the strip and the horizontal support structure, and the second leg of the framing accessory is positioned along the outer vertical surface of the wallboard panel.

14. The wall assembly of claim 13, wherein the header track comprises a flange and the flange comprises an outer surface, wherein the interior side surface of the strip faces the outer surface of the flange, wherein the interior side surface of the strip contacts the outer surface of the flange of the header track.

15. The wall assembly of claim 13, wherein the header track comprises a flange and the flange comprises an outer surface, wherein the interior side surface of the strip faces the outer surface of the flange, wherein the interior side surface of the strip is laterally spaced apart from the outer surface of the flange.

16. The wall assembly of claim 13, wherein the header track comprises a flange and the flange comprises an outer surface, wherein the interior side surface of the strip faces the outer surface of the flange, wherein the strip is positioned along the first leg such that the interior side surface of the strip is positioned between the outer surface of the flange of the header track and the free end of the first leg.

17. The wall assembly of claim 13, wherein the wallboard panel comprises a wallboard panel width and the first leg comprises a first leg width, wherein the wallboard panel width is greater than the first leg width.

18. The wall assembly of claim 13, wherein the strip comprises a first layer of material and a second layer of material, wherein at least one of the first layer of material and the second layer of material comprises material having intumescent properties.

19. A wall assembly comprising:
(a) a horizontal support structure comprising a lower surface;
(b) a header track attached to the horizontal support structure, wherein the header track comprises a web;
(c) a stud comprising an upper end received within the header track;
(d) a wallboard panel comprising a width, a top edge and an outer vertical surface, wherein the wallboard panel is positioned such that there is a gap between the top edge of the wallboard panel and the lower surface of the horizontal support structure, wherein the gap comprises a gap width that is equal to the width of the wallboard panel;
(e) a framing accessory comprising
(i) a first leg comprising a first end and a second end, wherein the second end of the first leg is closer to the stud than the first end of the first leg,
(ii) a second leg attached to the first end of the first leg and oriented substantially perpendicular relative to the first leg, and
(iii) a strip comprising an upper surface, a bottom surface opposite the upper surface of the strip, an interior side surface that extends between the bottom surface of the strip and the upper surface of the strip, and an outer side surface opposite the interior side surface of the strip, wherein the bottom surface extends from the interior side surface to the outer side surface, wherein the entire bottom surface is attached to the first leg, wherein the strip comprises a material selected from the group consisting of open cell foam and closed cell foam, wherein the framing accessory is positioned in the gap such that the first leg is positioned along the top edge of the wallboard panel vertically below the web of the header track, the second leg is positioned along the outer vertical surface of the wallboard panel, the gap is substantially filled by the first leg and the strip, and the strip is positioned between the first leg and the lower surface of the horizontal support structure such that the upper surface of the strip contacts the lower surface of the horizontal support structure thereby creating a seal between the strip and the horizontal support structure; and
(f) a layer of finishing material applied to the outer side surface of the strip and an outer surface of the second leg of the framing accessory.

20. The wall assembly of claim 19, wherein the framing accessory further comprises a third leg connected to the second end of the first leg, wherein the third leg is oriented substantially perpendicular relative to the first leg.

21. The wall assembly of claim 20, wherein the third leg is positioned between an inner vertical surface of the wallboard panel and a flange of the header track.

22. The wall assembly of claim 1, wherein at least 50% of the exterior surface of the first leg is covered by the strip.

23. The wall assembly of claim 1, wherein the first height of the framing accessory is between about 0.375 inches and about 3 inches.

24. The wall assembly of claim 13, wherein the strip comprises a material selected from the group consisting of fire resistant open cell foam and fire resistant closed cell foam.

25. The wall assembly of claim 24, wherein the seal prevents a spread of smoke at a head of wall joint.

26. The wall assembly of claim 13, wherein the seal reduces an amount of sound that passes through a head of wall joint.

* * * * *